US010650937B2

(12) United States Patent
Yoon

(10) Patent No.: US 10,650,937 B2
(45) Date of Patent: May 12, 2020

(54) LOW OHMIC LOSS SUPERLATTICE CONDUCTORS

(71) Applicant: University of Florida Research Foundation, Inc., Gainesville, FL (US)

(72) Inventor: Yong-Kyu Yoon, Gainesville, FL (US)

(73) Assignee: THE UNIVERSITY OF FLORIDA RESEARCH FOUNDATION, INC, Gainesville, FL (US)

( * ) Notice: Subject to any disclaimer, the term of this patent is extended or adjusted under 35 U.S.C. 154(b) by 0 days.

(21) Appl. No.: 16/066,147

(22) PCT Filed: Dec. 27, 2016

(86) PCT No.: PCT/US2016/068715
§ 371 (c)(1),
(2) Date: Jun. 26, 2018

(87) PCT Pub. No.: WO2017/117131
PCT Pub. Date: Jul. 6, 2017

(65) Prior Publication Data

US 2018/0374599 A1 Dec. 27, 2018

Related U.S. Application Data

(60) Provisional application No. 62/271,810, filed on Dec. 28, 2015.

(51) Int. Cl.
*H01B 1/02* (2006.01)
*H01B 11/06* (2006.01)
(Continued)

(52) U.S. Cl.
CPC ..... *H01B 1/026* (2013.01); *H01B 1/02* (2013.01); *H01B 1/023* (2013.01); *H01B 11/06* (2013.01);
(Continued)

(58) Field of Classification Search
CPC ..... H01B 1/023; H01B 1/026; H01B 11/06; H01B 11/18; H01B 1/02; H01B 7/30;
(Continued)

(56) References Cited

U.S. PATENT DOCUMENTS 3,451,793 A 6/1969 Matsushita
3,673,581 A 6/1972 Nishida et al.
(Continued)

FOREIGN PATENT DOCUMENTS

WO 2015/006660 A1 1/2015
WO WO-2015006660 A2 * 1/2015 ..... H01B 1/02

OTHER PUBLICATIONS

A low ohmic loss radial superlattice conductor at 15 GHz using eddy current canceling effect_Wu et al._pp. 1552-1553_Feb. 12, 2014.*

(Continued)

*Primary Examiner* — Timothy J Thompson
*Assistant Examiner* — Guillermo J Egoavil
(74) *Attorney, Agent, or Firm* — Thomas Horstemeyer, LLP

(57) ABSTRACT

Various examples are provided for superlattice conductors. In one example, a planar conductor includes a plurality of stacked layers including copper thin film layers and nickel thin film layers, where adjacent copper thin film layers of the copper thin film layers are separated by a nickel thin film layer of the plurality of nickel thin film layers. In another example, a conductor includes a plurality of radially distributed layers including a non-ferromagnetic core; a nickel layer disposed about and encircling the non-ferromagnetic core; and a copper layer disposed on and encircling the nickel layer. In another example, a hybrid conductor includes a core; and a plurality of radially distributed layers disposed about a portion of an outer surface of the core, the
(Continued)

plurality of radially distributed layers include alternating ferromagnetic and non-ferromagnetic layers. In other hybrid conductors, the radially distributed layers can utilize magnetic and non-magnetic materials.

20 Claims, 23 Drawing Sheets

(51) Int. Cl.
*H01B 7/30* (2006.01)
*H01B 11/18* (2006.01)

(52) U.S. Cl.
CPC ..... *H01B 11/1808* (2013.01); *H01B 11/1895* (2013.01)

(58) Field of Classification Search
CPC ..... H01B 11/1808; H01B 11/1895; H01L 23/49827; H01L 23/49866; H01L 23/49894; H01L 23/66; H01L 2223/6622; H01L 2223/6627; H01L 2924/0002
USPC ..... 174/71 C, 28
See application file for complete search history.

(56) References Cited

U.S. PATENT DOCUMENTS

| | | | | |
|---|---|---|---|---|
| 3,715,793 | A * | 2/1973 | Kefalas | G11B 5/004 365/173 |
| 5,600,297 | A * | 2/1997 | Ruigrok | B82Y 25/00 324/207.21 |
| 6,794,684 | B2 * | 9/2004 | Slater, Jr. | H01L 21/0485 257/103 |
| 9,679,671 | B2 * | 6/2017 | Yoon | H01L 23/49894 |
| 2008/0030906 | A1 | 2/2008 | Sato | |
| 2009/0126983 | A1 * | 5/2009 | Harvey | H05K 1/0233 174/266 |
| 2011/0128111 | A1 | 6/2011 | Roozeboom et al. | |

OTHER PUBLICATIONS

High Q-factor Ku Band Inductor Using Cylindrical Radial Superlattice Conductor and Air-lifted Architecture_Yoon_pp. 627-628_Oct. 8, 2014.*
Low Loss Conductors for CMOS and Through Glass_Silicon Via (TGV_TSV) Structures Using Eddy_Rahimi et al._pp. 736-741_May 2014.*
NiFeCo_Cu _Co System for MRAM_Kim et al._p. 25-29_1996.*
Spin Dependent Interface NiFeCo—Cu Superlatice_Diao et al._p. 6659-6676_Apr. 1998.*
Giant Magnetoresistances in NiFeCo—Cu Superlattices_Diao et al._p. 8227-8230_Apr. 1996.*
Suppre Skin Effect in Metal-Ferromag Supperlattice_Rejaei et al._pp. 6863 to 6868_Nov. 2004.*
CRS Cond for Low Loss Microwave_Rahimi et al_pp. 103911-1 to 103911-7_Mar. 2015.*
Low Loss Conductors for CMOS & TGV_TSV _Rahimi et al._pp. 736-741_May 2014.*
International Search Report in co-pending, related PCT Application No. PCT/US2016/068715, dated Mar. 16, 2017.
N. Sato, et al., "Skin effect suppression for Cu/CoZrNb multilayered inductor," Journal of Applied Physics 111, 07A501, Feb. 2012, pp. 1-3.
I. Iramnaaz, et al., "High quality integrated inductors based on multilayered meta-conductors," IEEE Microwave and Wireless Components Letters, vol. 22, No. 7, Jul. 2012, pp. 345-347.
Y. Zhuang, et al., "Magnetic-multilayered interconnects featuring skin effect suppression," IEEE Electron Device Letters, vol. 29, No. 4, Apr. 2008, pp. 319-321.
A. Rahimi, et al., "Low loss conductors for CMOS and through glass/silicon via (TGV/TSV) structures using eddy current cancelling superlattice structure," IEEE Electronic Components & Technology Conference, May 2014, pp. 736-741.
A. Rahimi, et al., "Cylindrical radial superlattice conductors for low loss microwave components," Journal of Applied Physics, vol. 117, No. 10, 103911, Mar. 2015, pp. 1-7.
Y.K. Yoon, et al., "Polymer-core conductor approaches for RF MEMS," IEEE Journal of Microelectromechanical Systems, vol. 15, No. 5, Oct. 2005, pp. 886-894.
M. Rais-Zadeh, et al. "MEMS switched tunable inductors," IEEE Journal of Microelectromechanical Systems, vol. 17, No. 1, Feb. 2008, pp. 78-84.
Y. Liu, et al., "Broadband complex permeability characterization of magnetic thin films using shorted microstrip transmission-line perturbation," Review of Scientific Instruments, vol. 76, (2005), pp. 1-8.
Jiyu Wu, et al., "A Low Ohmic Loss Radial Superlattice Conductor at 15 GHz using Eddy Current Canceling Effect," IEEE Antenna and Propagation Symposium 2013, pp. 1552-1553.
Arian Rahimi, et al., "High Q-factor Ku Band Inductor Using Cylindrical Radial Superlattice Conductor and Air-lifted Architecture," IEEE Antenna and Propagation Symposium 2014, 627-628.
I. Iramnaaz, et al., "Self-biased Low Loss Conductor Featured with Skin Effect Suppression for High Quality RF Passives," IEEE Transactions on Magnetics, vol. 48, No. 11, 2012, pp. 4139-4142.
Y. Liu, et al., "FeCoSiN film with ordered FeCo nanoparticles embedded in a Si-rich matrix," Applied physics letters, 90, 112506, 2007, pp. 1-3.
B. Rejaei, et al., "Suppression of skin effect in metal/ferromagnet superlattice conductors," Journal of Applied Physics, vol. 96, No. 11, Nov. 2004, pp. 6863-6868.
J. Ben Youssef, et al., "Thickness-dependent magnetic excitations in Permalloy films with nonuniform magnetization," Physical Review B 69, 174402, May 2004, pp. 1-9.
Iramnaaz et al. "High Quality Factor RF Inductors Using Low Loss Conductor Featured with Skin Effect Suppression for Standard CMOS/BiCMOS". IEEE 61st Electronic Components and Technology Conference (ECTC) (Jun. 2011) DOI: 10.1109/ECTC.2011.5898508.
Yamaguchi et al. "Skin effect suppression in multilayer thin-film spiral inductor taking advantage of negative permeability of magnetic film beyond FMR frequency". IEEE The 40th European Microwave Conference (Nov. 2010) DOI: 10.23919/EUMC.2010.5615880.

* cited by examiner

| Compound (g/L) | Concentration |
|---|---|
| Nickel Sulfate | 200 |
| Iron Sulfate | 8 |
| Nickel Chloride | 5 |
| Boric Acid | 25 |
| Saccharin | 3 |
| pH | 4 |
| Temperature | 24º C |
FIG. 16
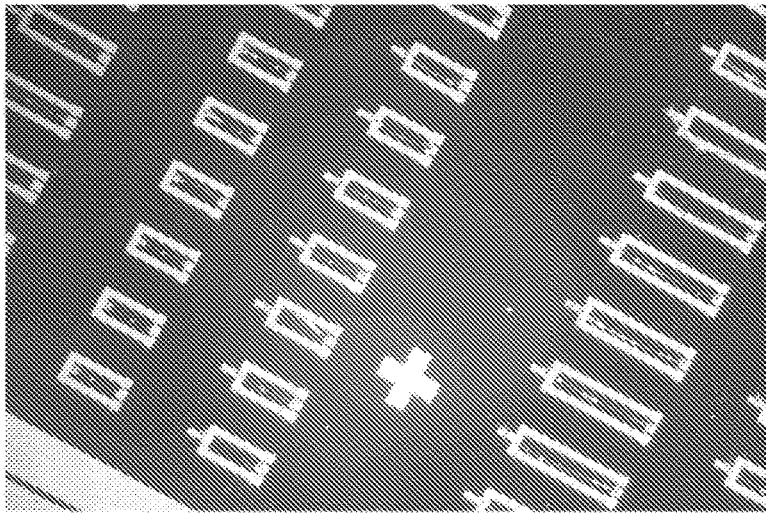
FIG. 17A
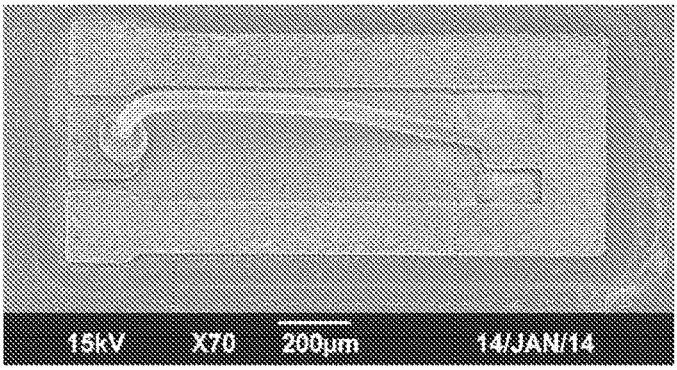
FIG. 17B
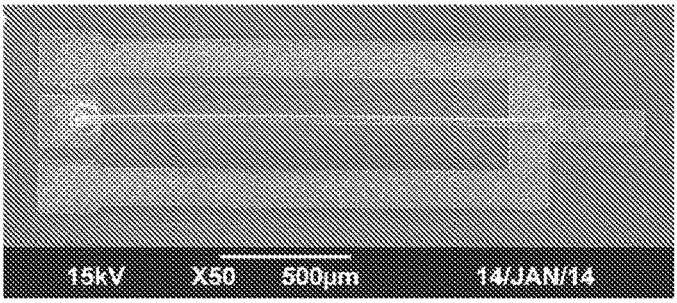
FIG. 17C $$Z_{diff} = Z_{11} + Z_{22} - Z_{12} - Z_{21}$$

$$R_s = Re\{ Z_{diff} \}$$

TABLE I STATE-OF-THE-ART COMPARISON

| Ref. | Multilayer Structure Material / (nm) | Width (μm) | Thickness (μm) | % of loss Reduction | FoM (GHz / Ω.μm) |
|---|---|---|---|---|---|
| [1] | Cu/CoZrNb 750/25 | 12 | 7.9 | 20 | 25.5 |
| [2] | Cu/NiFe 650/40 | 30 | 8.3 | 36 | 15.7 |
| [3] | Cu/NiFe 300/100 | 90 | 6.7 | 40 | 11.6 |
| **This Work** | **Cu/Ni 150/25** | **60** | **1.7** | **50** | **68.6** |

| Material | Saturation Magnetization [T] | Antiresonance frequency [GHz] |
|---|---|---|
| $Ni_{80}Fe_{20}$ (Permalloy) | 1.0 | 28 |
| $Ni_{50}Fe_{50}$ (Deltamax) | 1.6 | 45 |
| $Co_{50}Fe_{50}$ (Permendur) | 2.4 | 67 |
| FeCoB | 1.9 | 53 |
| FeCoSiN | 1.0 | 45 |
| Fe | 2.2 | 61 |
| Ni | 0.5 | 36 |
| 3% SiFe | 2.0 | 56 |

LOW OHMIC LOSS SUPERLATTICE CONDUCTORS

CROSS-REFERENCE TO RELATED APPLICATION

This application is the 35 U.S.C. 0.371 national stage application of PCT Application No. PCT/US2016/068715, filed Dec. 27, 2016, the entirety of which is hereby incorporated by reference, and which also claims priority to, and the benefit of, U.S. Provisional Application having Ser. No. 62/271,810, filed Dec. 25, 2015, the entirety of which is hereby incorporated by reference.

BACKGROUND

The conduction loss in the radio frequency (RF) and microwave frequency ranges is greatly influenced by the conductivity of the materials, the proximity effect, and the skin effect. The proximity effect and skin effect introduce high RF losses can result from magnetic fields generated by nearby conductors and from a magnetic field generated by the conductor itself, respectively. With the growing need for the high performance and high-speed electronic devices, the operation frequency of the next generation microelectronics and telecommunication devices continues to increase, which is expected to help mitigate the heavy traffic in the lower frequency bands and make the antenna system compacter, facilitating system miniaturization. The conductor loss will grow as the frequency increases as a result of the skin effect, in which the conductor's effective cross section area decreases.

SUMMARY

Embodiments of the present disclosure are related to superlattice conductors, which can provide low ohmic loss at radio frequencies.

In one embodiment, among others, a planar conductor comprises a plurality of stacked layers including: a plurality of copper thin film layers; and a plurality of nickel thin film layers, where adjacent copper thin film layers of the plurality of copper thin film layers are separated by a nickel thin film layer of the plurality of nickel thin film layers. In one or more aspects of these embodiments, individual nickel layers of the plurality of nickel thin film layers can have a thickness of less than 25 nanometers (nm). The thickness of the plurality of nickel thin film layers can be in a range from about 10 nm to about 15 nm. A thickness of individual copper layers of the plurality of copper thin film layers can be a predefined multiple of a thickness of individual nickel layers of the plurality of nickel thin film layers. The planar conductor can be included in one of a transmission line, an interconnect, an inductor, a transformer, an antenna, or a resonator.

In another embodiment, a conductor comprises a plurality of radially distributed layers including: a non-ferromagnetic core; a nickel layer disposed about and encircling the non-ferromagnetic core; and a copper layer disposed on and encircling the nickel layer. In one or more aspects of these embodiments, the plurality of radially distributed layers can comprise a plurality of nickel layers alternating with a plurality of copper layers. The conductor can comprise an insulation layer disposed on and encircling an outermost copper layer of the plurality of copper layers. The non-ferromagnetic core can comprise copper or a void containing air. The conductor can be a coaxial cable. The conductor can be included in one of a transmission line, an interconnect, an inductor, a transformer, an antenna, or a resonator. The interconnect can be a through silicon via (TSV), a through glass via (TGV), or a through organic via (TOV).

In another embodiment, a hybrid conductor comprises a core; and a plurality of radially distributed layers disposed about a portion of an outer surface of the core, the plurality of radially distributed layers comprise alternating magnetic and non-magnetic layers. In one or more aspects of these embodiments, the alternating magnetic and non-magnetic layers can be alternating ferromagnetic and non-ferromagnetic layers. The core can comprise a circular cross-section. The plurality of radially distributed layers can be disposed on about half of the outer surface of the core. The core can comprise a rectangular cross-section. The core can be a planar conductor. The plurality of radially distributed layers can be disposed on one side of the core. The core can consist of copper and the plurality of radially distributed layers can comprise alternating nickel and copper layers. The magnetic layers can comprise NiFe, FeCo, NiFeCo, NiFeMo, Co, CoNi, FePt, CoPt, and/or FeCoPt. The non-magnetic layers can comprise aluminum, copper, silver and/or gold.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims. In addition, all optional and preferred features and modifications of the described embodiments are usable in all aspects of the disclosure taught herein. Furthermore, the individual features of the dependent claims, as well as all optional and preferred features and modifications of the described embodiments are combinable and interchangeable with one another.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

FIG. 16 is a table showing the utilized NiFe electroplating solution bath for formation of a CRS conductor in accordance with various embodiments of the present disclosure.

FIGS. 17A-17D are images of fabricated CRS conductors of FIG. 14 in accordance with various embodiments of the present disclosure.

DETAILED DESCRIPTION

Figure 1A:
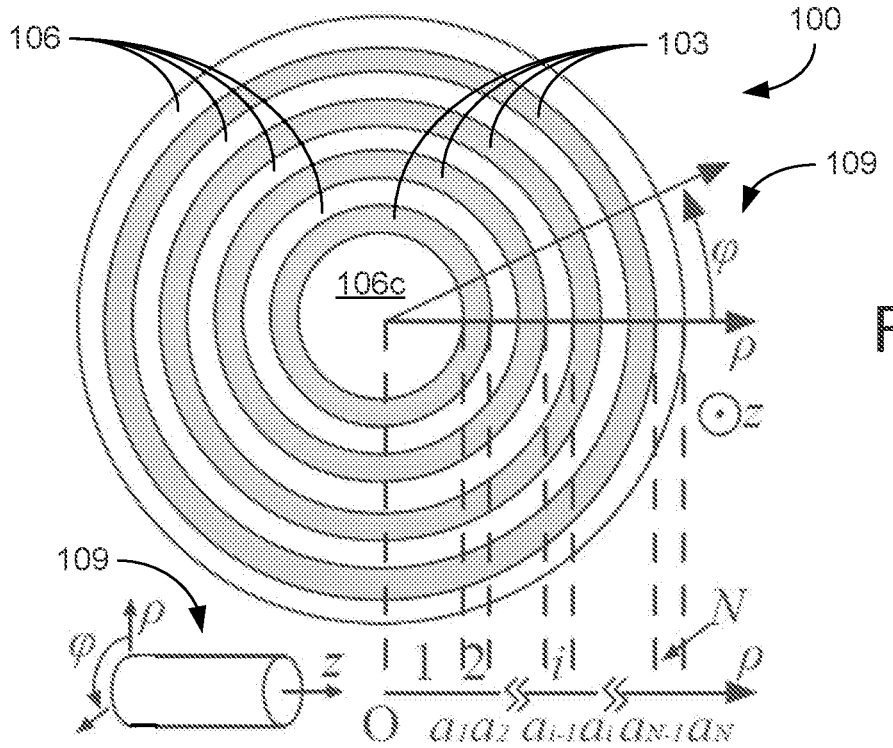
FIGS. 1A and 1B are graphical representations illustrating an example of a cylindrical radial superlattice (CRS) structure for a conductor in accordance with various embodiments of the present disclosure.

Disclosed herein are various examples related to embodiments of superlattice conductors. In this disclosure, examples of planar superlattice and cylindrical radial superlattice (CRS) conductors for improved radio frequency (RF) resistance suppression at a targeted RF frequency are discussed. For example, copper/nickel (Cu/Ni) paired superlattice conductors can provide reduced RF loss based upon eddy current cancelling (ECC). Reference will now be made in detail to the description of the embodiments as illustrated in the drawings, wherein like reference numbers indicate like parts throughout the several views.

The operational frequency of monolithic integrated circuits has reached the gigahertz (GHz) range in modern communication and consumer electronic applications. The clock frequency of today's microprocessors has reached 3 GHz and is moving to higher frequencies. One of the limiting factors of the high frequency operation is the radio frequency (RF) loss including the dielectric and conductor loss which are associated with the devices and circuits operating in the RF range. The dielectric loss could be reduced by locally removing the dielectric materials forming air-lifted architectures or using very low loss dielectric materials. Meantime, most electrodes or interconnectors utilize copper as the conducting material because of its low electrical resistivity, ease of deposition and moderate cost.

Copper is widely used as a low loss conductor in standard microfabrication processes of the integrated circuit (IC) and micro electromechanical systems (MEMS) industries mainly due to its high conductivity, ease of deposition and relatively low cost. However, at higher frequencies, its high conductivity is not as effective and beneficial as it is at low frequency and DC operation because of the skin effect, where most current is confined in the outermost surface of the conductor thus reducing the effective cross-section of the conductor and increasing the ohmic resistance. As a result, the effective cross section is reduced in RF frequencies and the resistance and conductor loss are increased. Therefore, the conductor loss together with the dielectric loss will increase the total loss of the systems operating at these higher frequencies.

These losses together with the inherent parasitic capacitance in those circuits result in the so called RC (resistance-capacitance) time delay, which can prevent the operating frequencies from going higher. The high frequency interconnects, transmission lines and vias in a standard CMOS process and in through silicon/glass via (TSV/TGV) structures can suffer from large conductor loss. In various embodiments, a via can pass through a silicon substrate, a glass substrate, an organic substrate, or other types of substrates as can be understood. The larger conductor loss will also be significant in high speed digital circuits including analog-to-digital/digital-to-analog converters and processors which will lead to a substantially large RC delay and limit the maximum operation frequency.

Superlattice structures can be used to reduce the conductor loss by forcing the current to flow over all the volume of the conductor instead of its edges. Reduction of the conduction loss from proximity and skin effects in conductors can improve performance of RF transmissions. The proximity effect can be partially alleviated by macroscopic patterning of the conductors and different constructions (e.g., a litz wire) while the skin effect demands more microscopic treatment.

In a planar superlattice structure, multiple layers of ferromagnetic/non-ferromagnetic metals can be used as the conductor where the negative permeability of the ferromagnetic material has the effect of cancelling out the eddy currents inside the conductor and allowing the current to flow inside the volume resulting in the reduction of the conductor loss. For example, a practical application of the planar superlattice structure includes RF inductors using a planar multilayered superlattice structure that is fabricated to provide skin effect suppression and increased quality factors. Multilayer interconnects can also improve the loss and quality factor of a coplanar waveguide (CPW) transmission line.

A planar superlattice structure of alternating ferromagnetic/non-ferromagnetic thin films deposited on each other in vertically stacked layers suppresses the skin effect and lowers the conductor loss. Because of the negative permeability of the ferromagnetic metal layers in frequencies above the magnetic resonance ($f_{MR}$), it is possible to make the effective permeability of the multilayer stack including the negative/positive permeability of the ferromagnetic/non-ferromagnetic metals close to zero and increase the skin depth. In this way, the current can be forced to flow through the volume of the conductor where the effective area is increased leading to a considerably lower conductor loss. Although the planar superlattice conductors can decrease the ohmic loss of the conductors in the high frequency region, the electromagnetic discontinuity at the edge of the conductor may exhibit large fringing effects, which may limit the eddy current suppression of the planar superlattice conductors in practice.

Skin effect suppression using a cylindrical radial superlattice (CRS) architecture, where the round shape conductors benefit from continuity and no edge fringing effect in the azimuthal direction, can be used in a microwave coaxial cable setup. Low conductor loss cylindrical via architectures using the CRS architecture including alternating nanoscopic ferromagnetic/non-ferromagnetic conductors, and the design procedure, will be disclosed for the high frequency TSV/TGV and CMOS via usage. Theoretical and numerical analyses of the CRS structure with circular and conformal boundary conditions demonstrate the suppression of skin effects and RF conductor loss. Operation of CRS conductors including alternating magnetic/nonmagnetic nanolayers working in the microwave range is demonstrated and an implementation of a high Q-factor microwave inductor made of the CRS conductor exhibited a Q-factor of 45 at 18 GHz, which may be attributed to the low conductor and dielectric losses.

Superlattice structures comprising ferromagnetic/non-ferromagnetic metals can be used to create high performance conductors for radio frequency (RF) structures (e.g., RF transmission lines and low loss vias in CMOS and through silicon/glass via (TSV/TGV) structures) whose ohmic resistance and resistance-capacitance (RC) delays have been reduced. Two permalloys of $Ni_{80}Fe_{20}$ and FeCo are studied as the ferromagnetic materials with low and high magnetization saturation that can be used for designing superlattice structures with low and high GHz frequency ranges, respectively. The effects of design parameters including the number of layers and thickness ratio of the superlattice structures have been studied. Full wave simulations have been used to verify them. Finally, a radial superlattice structure consisting of NiFe/Cu layers has been implemented and its resistance has been compared with the control solid-core devices made of solid copper; proving the effectiveness of the proposed radial superlattice structure for reducing the RF loss.

In addition, superlattice structures including Cu/Ni layers are presented. The usage of Ni as the ferromagnetic material in the non-ferromagnetic/ferromagnetic superlattice structure can be advantageous as Ni has a high contrast between in-plane and out-of-plane magnetic coercivity fields suitable for effective thin film superlattice eddy current cancellation (ECC), is abundant, and does not require a stoichiometric control of composition as other alloy magnetic materials do while its negative permeability effectively cancels out the positive permeability of copper in the frequency of interest. A transmission line consisting of 10 superlattice Cu/Ni layers with each layer having a thickness of 150 nm/25 nm totaling 1.75 μm thick can exhibit the same resistance value as another transmission line consisting of 10 Cu/Ni layers with each layer having a thickness of 600 nm/100 nm totaling 7 μm thick at 13 GHz, revealing a 75% conductor volume reduction. Experimental results show an improvement of more than three times in the figure of merit defined as frequency/effective resistivity, when compared with other state-of-the-art devices.

The RF ohmic loss reduction can be achieved with a non-ferromagnetic conductor such as, e.g., copper accompanied by ferromagnetic materials with negative permeability in close proximity, which will result in reversely magnetized eddy currents compared to positive eddy currents due to copper, canceling out both eddy currents from the two conductors in the neighboring conductor, the so called eddy current cancelling effect. The dynamic frequency response of ferromagnetic thin films with uniaxial anisotropy is given by the Landau-Lifshitz-Gilbert (LLG) equation, where the relative permeability is:

$$\mu_r = \frac{\gamma^2 M_s^2}{\mu_0} \frac{1}{M_{FMR}^2 - \omega^2 - 2j\omega\gamma\sqrt{\frac{M_s H_c}{\mu_0}}}, \tag{1}$$

where $M_s$ is the magnetization saturation, $\gamma$ is the gyromagnetic ratio, $\mu_0$ is the free space permeability, $\omega=2\pi f$ is the angular frequency, $H_c$ is the coercivity field and co is the angular frequency. Based on the LLG equation (1), the real part of the relative permeability of the ferromagnetic material is negative above its ferromagnetic resonance frequency, $\omega>\omega_{FMR}$, where it could be used for eddy current cancelling purposes in the RF regime.

The skin effect can be characterized in homogeneous structures by the skin depth ($\delta$) as described by:

$$\delta = \sqrt{\frac{2}{\omega\mu_0\mu_r\sigma}}, \tag{2}$$

where $\omega=2\pi f$ is the angular frequency, $\mu_0$ is the free space permeability, $\mu_r$ and $\sigma$ are the relative permeability and effective conductivity of the conductor, respectively. Skin effect suppression and its applications may be based on a planar superlattice architecture, where the conductor has a finite conductor width and thickness. Because of the finite conductor dimensions and the boundary conditions, the accuracy of the analytical solution may be hampered. Meantime, certain resistance suppression can be achieved, while the tunability and performance may be further engineered.

From equation (2), by setting the $\mu_r$ inside the conductor to a value very close to zero, it is possible to enlarge the skin depth. By assuming that the conductor carrying the high frequency signal comprises multiple non-ferromagnetic and ferromagnetic layers, the effective permeability of the multi-layer superlattice conductor is, $$\mu_{eff} = \frac{\mu_N t_N + \mu_F t_F}{t_N + t_F}, \tag{3}$$

where $\mu_N$ and $\mu_F$ are the permeability of the non-ferromagnetic and ferromagnetic metals, and $t_N$ and $t_F$ are their thicknesses, respectively. Since $\mu_F<0$ in operational frequencies, that would be possible to set $\mu_{eff}\approx 0$ when $t_N/t_F=|\mu_F|$ and therefore an infinite skin depth can be obtained by plugging $\mu_{eff}\approx 0$ into equation (2). In other words, the current can be distributed uniformly in a multi-layer conductor and the whole cross section of the conductor can be used for current flow. The permeability of a thin film ferromagnetic material is given by:

$$\mu=\mu'+j\mu'' \tag{4}$$

where $\mu'$ is the real part and $\mu''$ is the imaginary part of the permeability. The LLG equation (1) can be used to estimate the dynamic response of the ferromagnetic thin film from which the complex permeability of the thin film can be given by:

$$\mu = \left\{1 + \gamma^2 4\pi M_s + \frac{[H_{Kp} - H_{Ku} + 4\pi M_s + j\omega\alpha/\gamma]}{\gamma^2 H_{Kp}[H_{Kp} - H_{Ku} + 4\pi M_s] - \omega^2 + j\omega\alpha\gamma[2H_{Kp} - H_{Ku} + 4\pi M_s]}\right\} \times \frac{\tanh[(1+j)t/(2\delta)]}{(1+j)t/(2\delta)} \tag{5}$$

where $M_s$ is the magnetic saturation of the thin film, $H_{Kp}$ is the in-plane anisotropy field, $H_{Ku}$ is the out-of-plane anisotropic field, $\gamma$ is the gyromagnetic ratio, $\alpha$ is the Gilbert damping parameter, and t is the thickness of the thin film. The skin depth, $\delta$, is calculated by using equation (2).

Figure 1B:
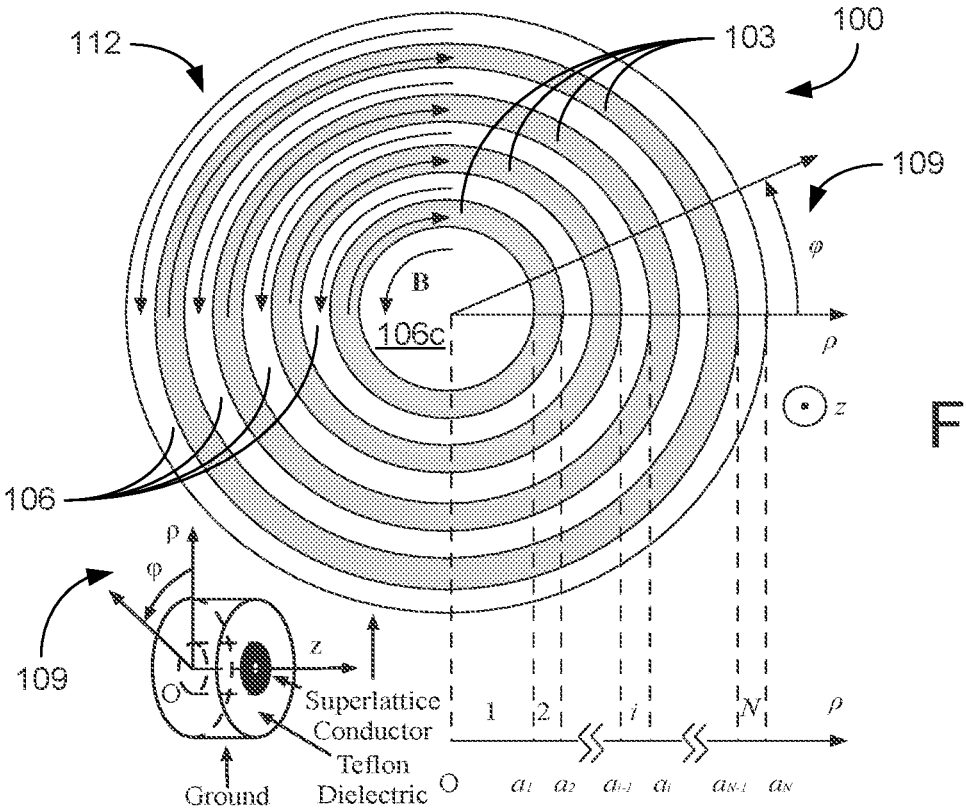

Referring to FIGS. 1A and 1B, shown is an example of a CRS structure 100 composed of alternating concentric layers of permalloy 103 and non-permalloy material 106 such as, e.g., aluminum (Al) for a low loss radio frequency (RF) conductor. Permalloy includes, e.g., NiFe, FeCo, NiFeCo, NiFeMo, etc. In some embodiments, other magnetic materials (e.g., Co, CoNi, FePt, CoPt, FeCoPt, etc.) can be utilized in place of the permalloy materials. Non-permalloy materials include, e.g., aluminum, copper, silver, gold, etc. The CRS structure 100 utilizes an eddy current canceling effect produced by the alternating permalloy layers 103 and non-permalloy layers 106 at the targeted frequency. Theoretical and numerical analyses are presented in the cylindrical coordinate system. Compared with a conventional planar superlattice, the CRS offers a circular and conformal boundary condition, resulting in better analytical and numerical solutions for the suppression of RF conductor loss. For example, with the CRS structure 100 of FIGS. 1A and 1B, RF resistance may be reduced by up to 90% at 15 GHz when compared to a solid conductor.

The concentric superlattice is implemented, using N alternating layers of permalloy 103 and non-permalloy materials 106, to produce a cylindrical structure with a total radius of $a_N$. As shown in FIGS. 1A and 1B, a non-permalloy core 106*c* forms the first layer with a radius of $a_1$. The CRS structure 100 contains only one boundary condition between each layer 103 and 106. The CRS structure 100 will be further discussed using a cylindrical coordinate system ($\rho$, $\phi$, z) 109. In the example of FIGS. 1A and 1B, the permalloy layers 103 and non-permalloy layers 106 (e.g., Al or other appropriate conductive material) are designed to produce negative-permeability and positive permeability, respectively, at the frequency of interest, canceling the eddy currents generated by the alternating layers and suppressing RF conductor loss.

The non-permalloy core 106*c* may be the same non-permalloy material as the other non-permalloy layers 106 or may be a different non-permalloy material. For example, the non-permalloy core 106*c* may be a non-conducting material or electrical insulator such as, e.g., a polymer. In some implementations, the non-permalloy core 106*c* may be a void containing, e.g., air or other inert gas. In other embodiments, the non-permalloy core 106*c* may include a non-permalloy material with an axial void. An insulation layer (not shown) can be disposed around the CRS structure 100 (e.g., encircling an outermost non-permalloy layer 106 of FIGS. 1A and 1B) for electrical isolation and protection.

Due to the fact that the skin depth is getting smaller as the frequency increases, the ohmic loss unavoidably keeps rising in a regular conductor. FIG. 1B shows a schematic diagram illustrating a cross-section view of a conductor with a CRS structure 100 that is used to suppress the ohmic loss. The example of FIG. 1B shows the CRS conductor with a ferromagnetic as the permalloy layers 103 (grey regions) and a metal thin film as the non-permalloy layers 106 (white regions) with N layers and a total radius $\rho=a_N$ in the cylindrical coordinate system. Although the permeability of the non-ferromagnetic layers is constant and does not vary with respect to frequency ($\mu_N=1$ at all frequencies), the permeability of the ferromagnetic metal layers is a function of the frequency and is negative between the ferromagnetic resonance frequency ($f_{MR}$) and the anti-resonance frequency ($f_{AR}$). The arrows 112 show the direction of the induced magnetic fields upon current flows along with z-axis. The magnetic field lines are opposing each other in the design frequency region due to the negative permeability of the ferromagnetic thin film layers 103.

When operating between $f_{MR}$ and $f_{AR}$, the real part of the permeability ($\mu'$) is negative. Therefore, the ratio of the thickness of the non-ferromagnetic metal layer (e.g., copper or aluminum) and the ferromagnetic metal layer $t_N/t_F$ is an important design parameter which determines the operation frequency. By properly choosing the thickness ratio based on equation (3), it is possible to make the effective magnetic permeability close to zero and enlarge the skin depth, resulting in the reduction of the conduction loss in the frequency range of interest.

Figure 2A:
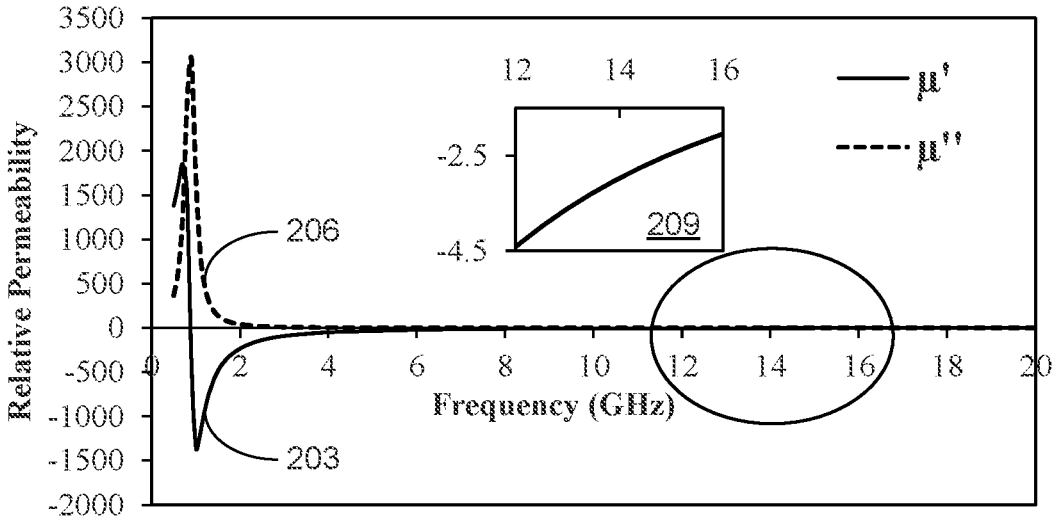
FIGS. 2A and 2B are plots illustrating examples of the relative complex permeability of permalloy spectra in accordance with various embodiments of the present disclosure.

The dynamic response of permalloy thin films has been investigated theoretically and experimentally. Permalloy (e.g., $Ni_{80}Fe_{20}$) films are one of the most commonly studied soft magnetic materials, whose complex permeability spectra can be characterized by the Landau-Lifshitz-Gilbert equation. The complex permeability can be expressed by equation (4) with μ' as the real part and μ" as the imaginary part. Referring to FIG. 2A, shown is a plot illustrating an example of the relative complex permeability of the permalloy spectra. The calculated permeability of the permalloy assumes no external magnetic field. The inset portion 209 shows the real part μ' for the frequencies between 12 GHz and 16 GHz.

Figure 2B:
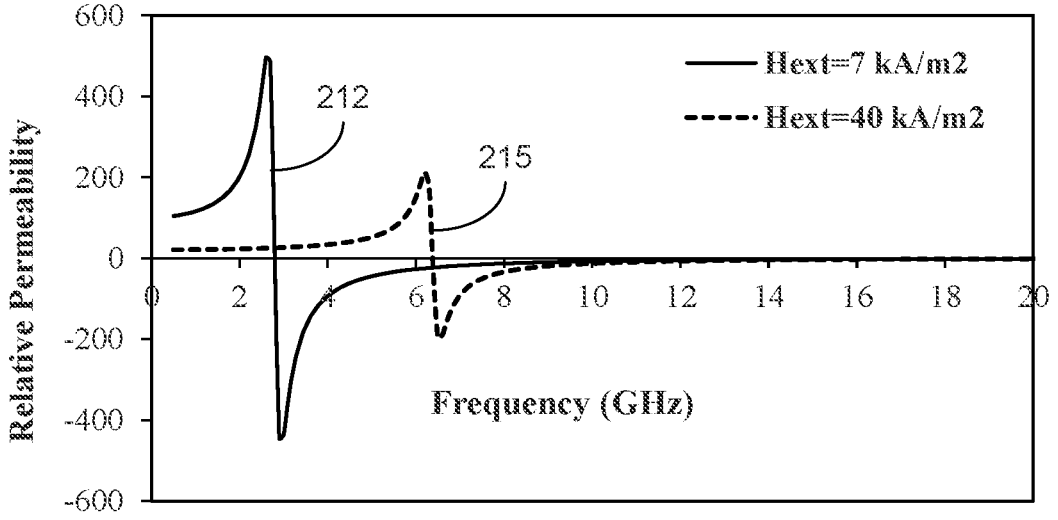

The example of FIG. 2A shows the calculated permeability of the $Ni_{80}Fe_{20}$ using the LLG equation where the magnetic saturation $M_S$=10,000 G=1 T for permalloy, the in-plane anisotropy field $H_{Kp}$=10 Oe, the out-of-plane anisotropic field $H_{Ku}$=10 Oe, the gyromagnetic ratio $\gamma=1.75\times10^7$ $s^{-1}Oe^{-1}$, the Gilbert damping parameter $\alpha$=0.01, and t is the typical thickness of the thin film. The skin depth, δ, is calculated by using the electrical conductivity of permalloy and copper where $\sigma_{permalloy}=6\times10^6$ S/m and $\sigma_{Cu}=5.8\times10^7$ S/m, respectively. The resonance frequency of permalloy thin film, $f_{MR}\approx900$ MHz and the anti-resonance frequency is $f_{AR}\approx28$ GHz. FIG. 2B shows the tunability of the permeability of the ferromagnetic materials by using an external magnetic field ($H_{ext}$). The $f_{MR}$ frequency shifts to higher frequencies as $H_{ext}$ increases from 7 kA/m$^2$ (curve 212) to 40 kA/m$^2$ (curve 215). Therefore, the $\mu_F$ in equation (3) also shifts, making it possible to design the conductor for multiple target frequencies. For example, a CRS conductor can be used to implement tunable inductors, transformers, metamaterials, resonators, filters, antennas, and/or interconnects.

Figure 3A:
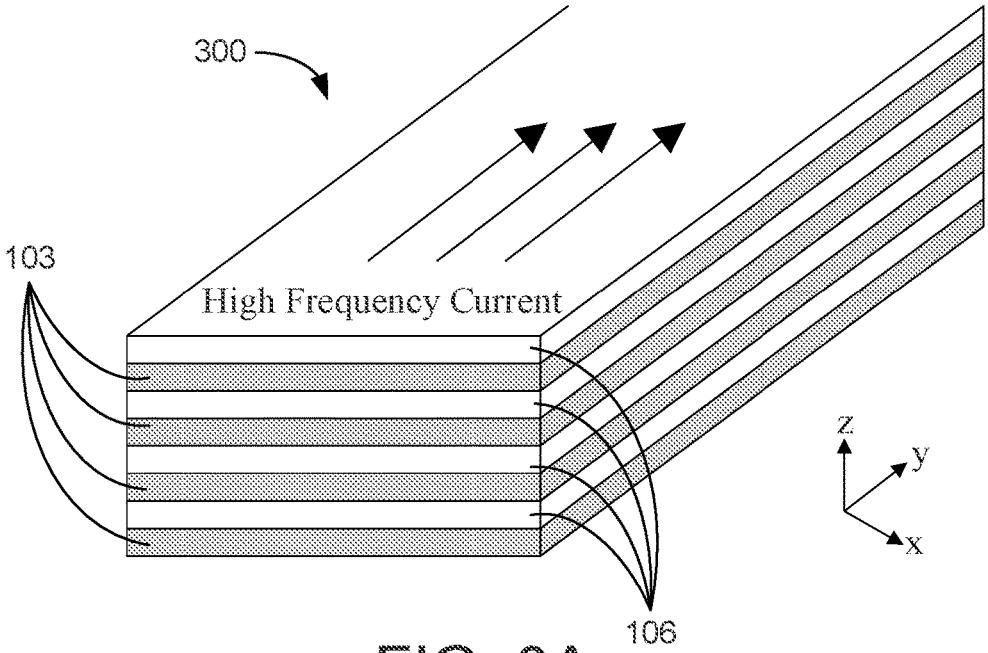
FIGS. 3A-3C are graphical representations illustrating an example of a planar superlattice structure for a conductor in accordance with various embodiments of the present disclosure.

Referring next to FIG. 3A, shown is a conductor using a planar superlattice structure 300 including layers of permalloy 103 and non-permalloy material 106, where the high frequency current is flowing in the longitudinal y-direction with a transverse magnetic field flowing along each layer in the x-direction. The negative permeability of the ferromagnetic layers 103 operating in the design frequency results in a longitudinal direction eddy current opposite to the one generated by metal layers 106 with positive permeability. By manipulating the forward and reverse eddy currents to the extent that they are evenly cancelled in each layer, the skin depth and the effective area will be enlarged, the alternating current flow will be more uniform, and the microwave resistance at the designed frequency range will be reduced. The planar superlattice conductor 300 can have an electromagnetic discontinuity at the edge of the conductor, which can result in large fringing effects that may limit the eddy current suppression of the planar superlattice conductor in practice.

Figure 3B:
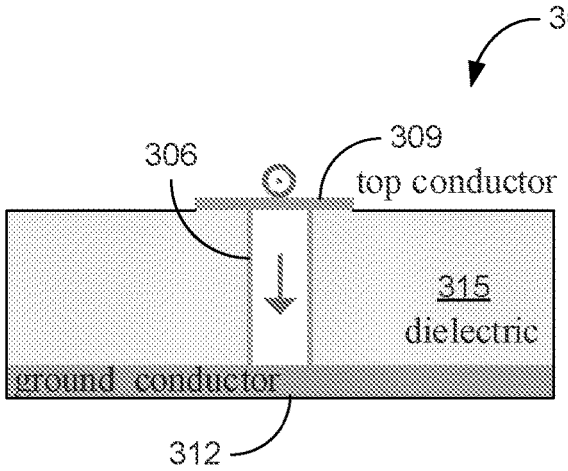
Figure 3C:
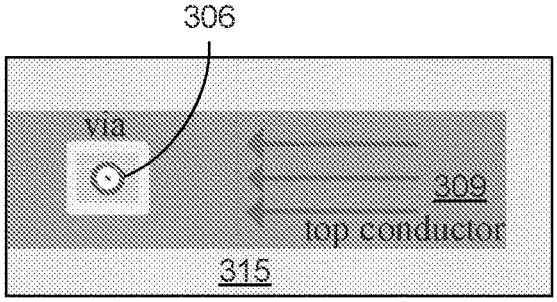

FIGS. 3B and 3C show a cross-sectional view and a top view, respectively, of a microstrip transmission line 303 with a via 306 connecting the top conductor 309 to the bottom ground plate 312 through a dielectric layer 315. Vias 306 are used in standard CMOS or TSV/TGV processes to vertically connect horizontal conductors. Therefore, to benefit from the eddy current cancelling structure in a via 306, stacked layers should be grown inside the via opening.

To overcome such drawbacks of the planar superlattice conductors, a CRS structure can be used that has a closed boundary condition in an azimuthal direction and therefore is considered more appropriate for eddy current suppression and low conductor loss. A coaxial line using the CRS structure 100 will be evaluated. A radial superlattice via (RSV) structure will also be examined where the CRS structure has been employed to fabricate low loss vias to replace the vias that are known to produce high loss in a CMOS or TSV/TGV process. FIG. 1B depicts the cross section of the CRS conductor where the arrows show the generated magnetic fields when an alternating current is flowing in z-direction.

Figures 4A, 4B:
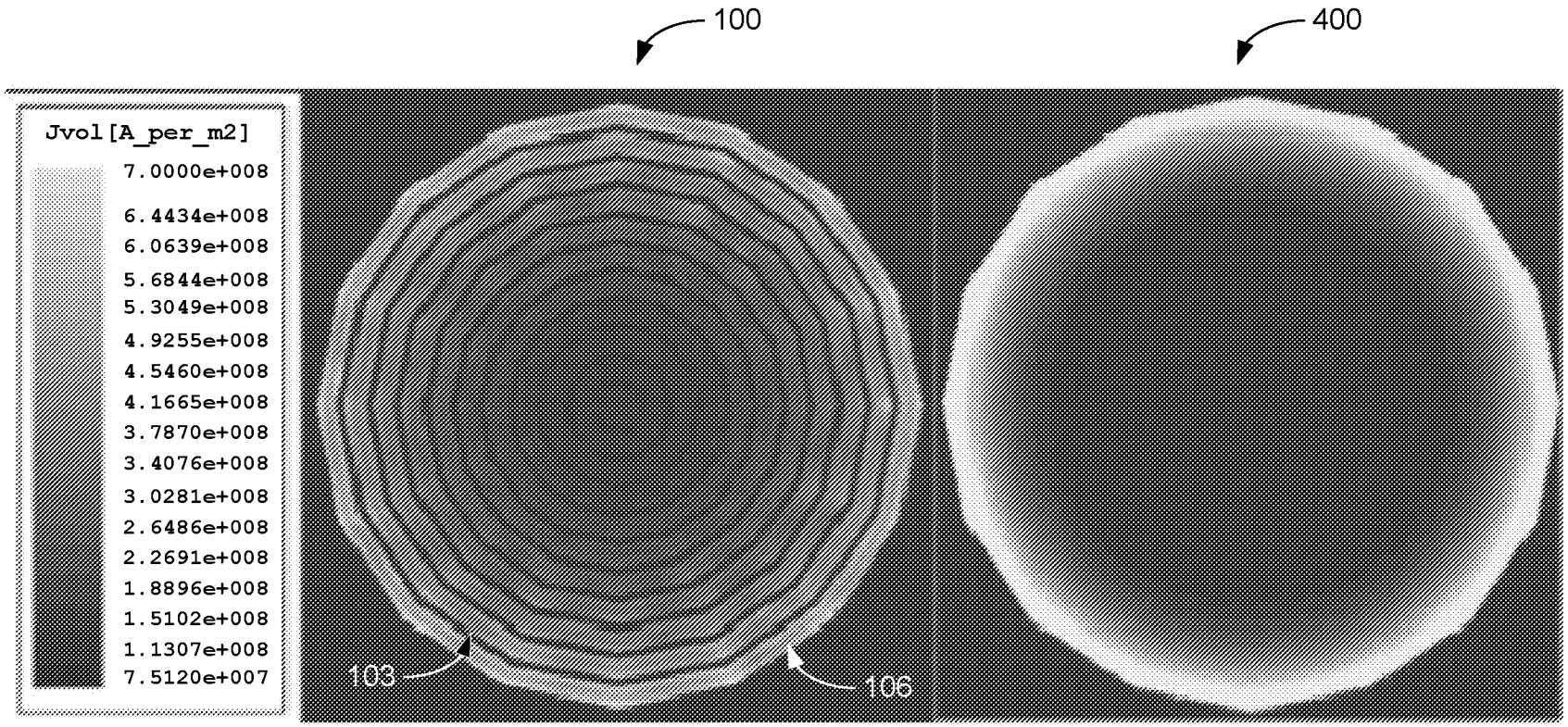
FIGS. 4A and 4B are graphical representations of an example of current density in a CRS conductor of FIGS. 1A and 1B and a solid conductor, respectively, in accordance with various embodiments of the present disclosure.

A coaxial line using the CRS structure 100 of FIGS. 1A and 1B was simulated to verify the design theory. Applications for a conductor using the CRS structure 100 include, but are not limited to, a coaxial cable, an inductor, a transformer, an antenna, a resonator, a metamaterial, and an interconnect such as, e.g., a thru-silicon-via (TSV), a thru-glass-via (TGV), or a thru-organic-via (TOV). Simulation was performed using a high frequency structure simulator (e.g., HFSS, Ansys Inc.) simulating a CRS structure 100 including alternating layers of permalloy and aluminum (Al). In order to match the impedance of the coaxial line to 50Ω in HFSS, the outer diameter was designed to be 20.1 μm, the inner diameter of the metallic line was 12 μm, and the total length of the conductor was 20 μm. FIG. 4A is a cross-sectional view of the simulated CRS structure 100*a*, which included 21 alternating layers with 10 permalloy layers 103 separating 11 Al layers 106. The layer thicknesses were determined for an operating frequency of 15 GHz. As can be understood, the CRS structure 100 can be determined other targeted frequencies of interest. The CRS structure 100 can be tuned to the targeted frequency by choosing appropriate permeable materials and geometries of the CRS structure 100.

FIG. 4A graphically illustrates an example of the current distribution (in A/m$^2$) in the simulated CRS structure 100*a* at 15 GHz. As can be seen in FIG. 4A, at least a portion of the current flows through each of the Al (or non-permalloy) layers 106. The current density of the outermost Al layer 106 is highest and the current densities of the inner Al layers 106 decrease towards the center of the CRS structure 100*a*. For comparison, FIG. 4B shows a cross-sectional view that graphically illustrates the current distribution (in A/m$^2$) in a solid Al conductor 400 under the same conditions. The skin effect concentrates the currents at the outer edge of the conductor 400 with little or no current flowing through the center portion of the conductor 400.

Figure 5:
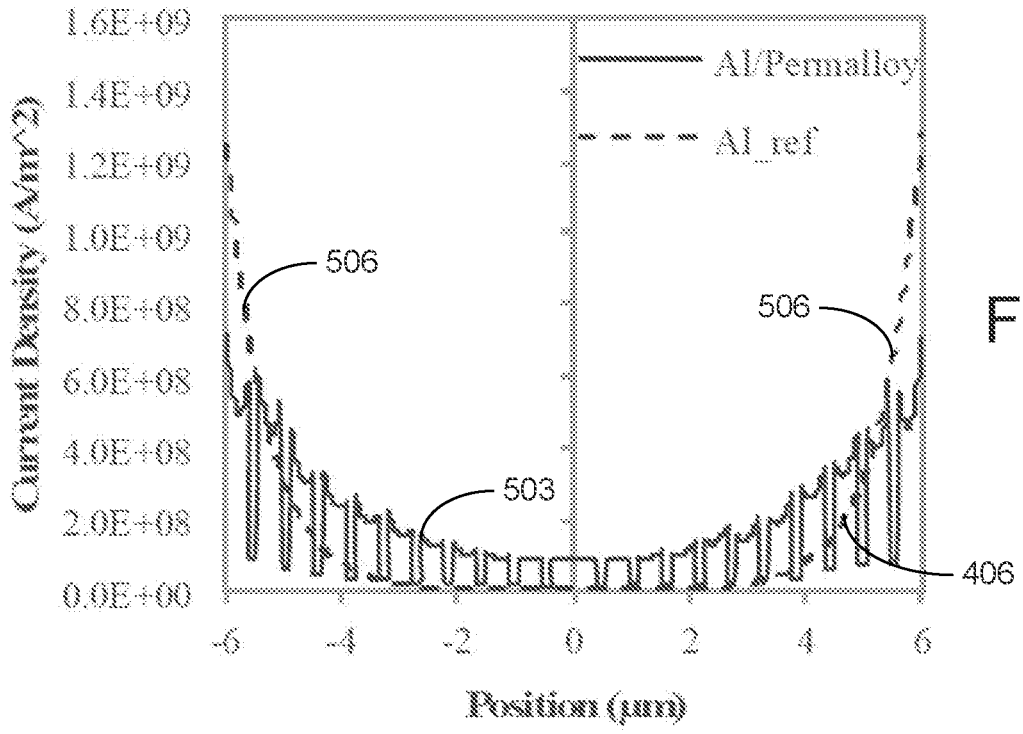
FIG. 5 is a plot illustrating examples of current densities in a CRS conductor of FIGS. 1A and 1B and a solid conductor in accordance with various embodiments of the present disclosure.

FIG. 5 is a plot showing an example of the current distributions of the simulated CRS structure 100*a* (solid curve 503) and the solid Al reference conductor 400 (dashed curve 506) at 15 GHz. As discussed, the current density in the solid Al conductor 400 is concentrated at the outer edge of the solid conductor 400, while the CRS structure 100*a* exhibits lower current densities at the outer edge of the conductor and higher current densities in the central portion of the conductor.

Figure 6:
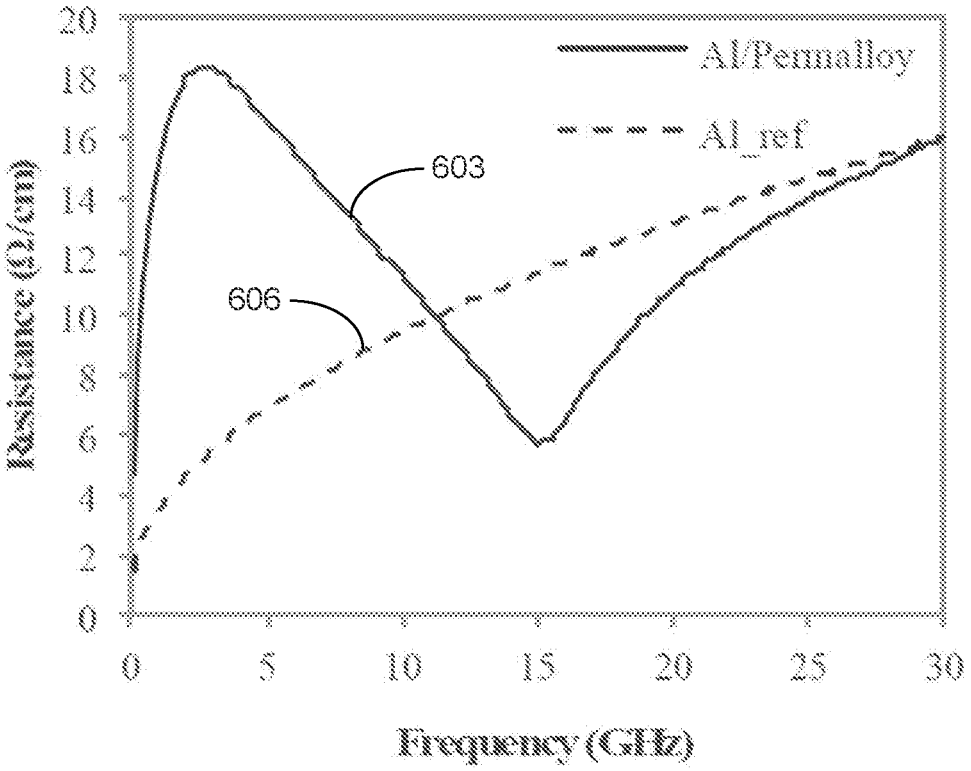
FIG. 6 is a plot illustrating examples of resistance spectra of a CRS conductor of FIGS. 1A and 1B and a solid conductor in accordance with various embodiments of the present disclosure.

Using a lumped element circuit model, the conduction resistance of the coaxial conductor with the CRS structure 100*a* can be extracted. The simulation results revealed that the resistance of a coaxial conductor having the simulated CRS structure 100*a* can be at least 50% lower than that of the solid Al conductor 400 at 15 GHz. The effective bandwidth of the ohmic loss reduction is between 12 GHz and 30 GHz as shown in FIG. 6. Examples of the resistance spectra for the coaxial conductor (solid line 603) and the solid Al reference conductor 400 (dashed curve 606) were plotted.

A cylindrical radial superlattice (CRS) conductor including alternating permalloy and Al layers has been demonstrated with a conduction resistance reduction of 50% at 15 GHz. By manipulating the magnetic field in each layer of the superlattice, eddy currents from the non-permalloy (e.g., Al) and permalloy layers cancel each other and result in a more uniform current distribution through the cross-section of the CRS conductor. The eddy current canceling effect lowers the RF resistance of the CRS conductor, and the resistance spectra can be controlled by configuring the specific thickness of each layer based on the dynamic permeability of the superlattice film. The design theory and simulation results have been presented.

Figure 7:
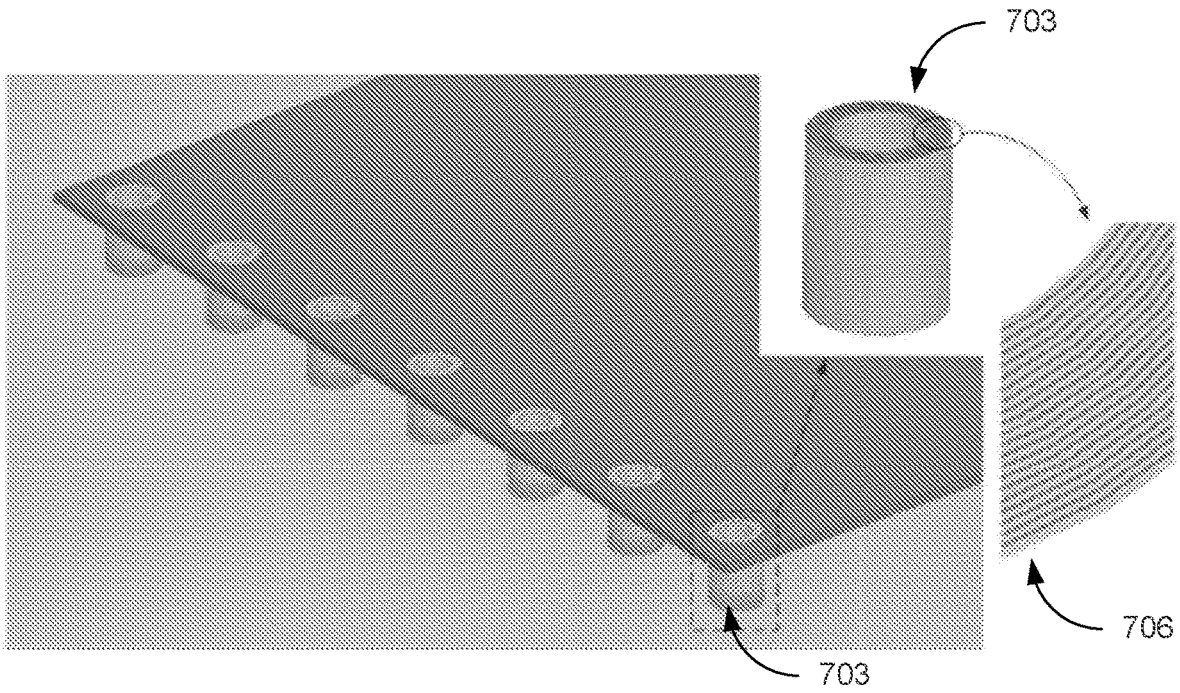
FIG. 7 is a graphical representation of radial superlattice vias (RSVs) constructed using the CRS structure of FIGS. 1A and 1B and a solid conductor in accordance with various embodiments of the present disclosure.

FIG. 7 shows an example of typical through silicon vias/through glass vias (TSV/TGV) 703 where the radial superlattice vias (RSV) structure, shown in cross-sectional view 706, has been employed to reduce the ohmic loss of the vias 703. The RSV can be constructed using the CRS structure in a typical RF MEMS process. An analysis of superlattice vias is followed by full-wave simulations using a high frequency structure simulator (HFSS, ANSYS Inc.) that validate the effectiveness of the CRS structure for conductor loss reduction in vias. The RVS structure can include a plurality of layers surrounding a hollow core or void, as illustrated in FIG. 7, or can include a solid core as illustrated in FIGS. 1A and 1B.

Figure 8:
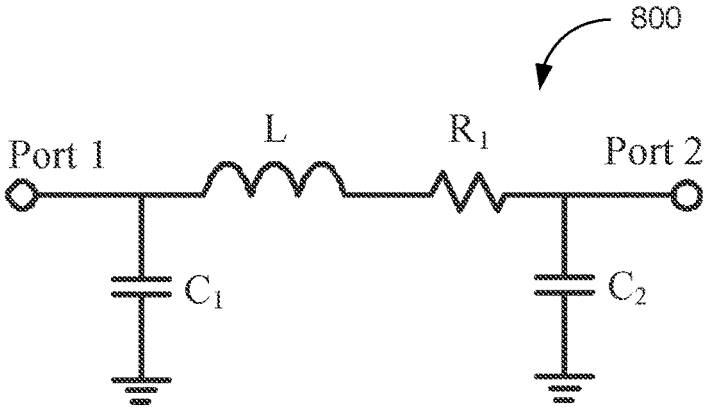
FIG. 8 is an example of a lumped element circuit model of a CRS conductor of FIGS. 1A and 1B and a solid conductor in accordance with various embodiments of the present disclosure.

The CRS conductor comprises a solid core conductor covered by laminated superlattice structures (FIG. 1B) where a ground plane was used underneath the structure, forming a coaxial structure, to allow propagation of transverse electromagnetic (TEM) waves. The lumped element equivalent circuit model 800, as shown in FIG. 8, will be used to extract the conduction resistance of the conductor. By analyzing the Y-parameters, the values of the equivalent circuit elements can be expressed as, $$\mathrm{Re}[Y21] = \frac{-R_1}{R_1^2 + \omega^2 L_1^2}, \tag{6a}$$

$$\mathrm{Im}[Y21] = \frac{\omega L_1}{R_1^2 + \omega^2 L_1^2}, \tag{6b}$$

where the resistance and inductance can be found by solving equations (6a) and (6b) to give:

$$L_1 = \frac{\mathrm{Im}[Y21]}{\omega[(\mathrm{Re}[Y21])^2 + (\mathrm{Im}(Y21))^2]}, \tag{7a}$$

$$R_1 = \frac{(-\mathrm{Re}[Y21])^{-1} \pm \sqrt{(\mathrm{Re}[Y21])^{-2} - 4\omega^2 L_1^2}}{2}. \tag{7b}$$

Figure 9:
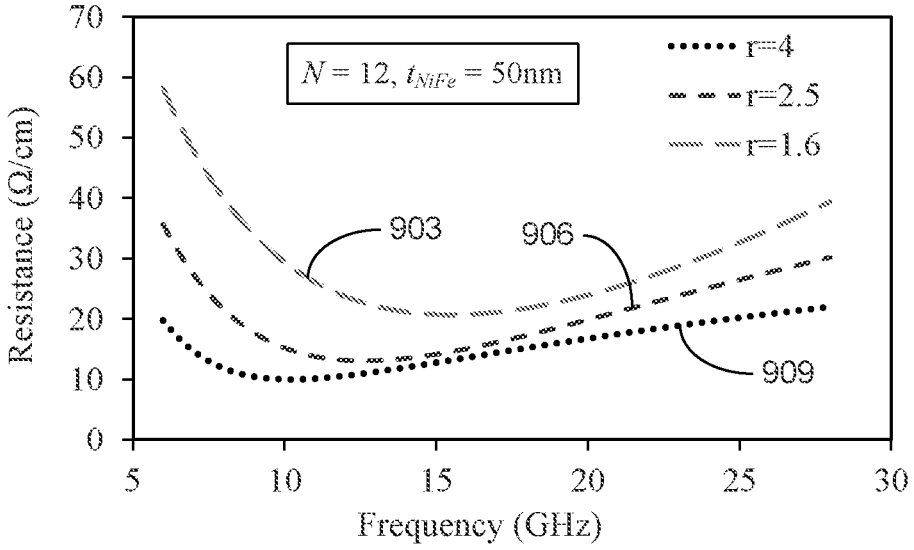
FIGS. 9-13 are graphical representations of examples of simulation results for the CRS structure of FIGS. 1A and 1B in accordance with various embodiments of the present disclosure.

As previously discussed, copper is widely used as the conductor in standard manufacturing processes that has high conductivity and can be deposited using standard microfabrication processes. Referring to FIG. 9, shown are the simulation results of the RSV structure where NiFe/Cu are used as the magnetic/non-magnetic metal layers. The relatively low magnetization saturation of the NiFe allows the RSV to operate in the lower frequency region (e.g., about 5 GHz to about 20 GHz). The extracted resistance of the radial superlattice conductor using equations (7a) and (7b) has been compared to that of a solid conductor with the same thickness, but including no laminated structure. The simulation results of three NiFe/Cu RSV structures with N=12 layers and a NiFe layer thickness of $t_{NiFe}$=50 nm were plotted.

In the example of FIG. 9, the resistance of the NiFe/Cu conductor was simulated where the effect of different thickness ratios of the non-ferromagnetic copper layer and the ferromagnetic NiFe layer ($r=t_N/t_F=t_{Cu}/t_{NiFe}$) was evaluated to show the capability of tuning the operational frequency (frequency where the resistance spectra is minimum) while maintaining the number of layers (N) and the thickness of the NiFe ($t_{NiFe}$) constant. Curve 903 corresponds to r=1.6 and $t_{Cu}$=80 nm, curve 906 corresponds to r=2.5 and $t_{Cu}$=125 nm, and curve 909 corresponds to r=4.0 and $t_{Cu}$=200 nm. The frequency at which the effective permeability is closest to zero indicates the minimum ohmic resistance, which can be tuned based on the given thickness ratio r. By increasing the thickness ratio, the minimum frequency shifts to lower frequencies. The conductor with r=4.0 (curve 909) has the lowest minimum resistance because the overall conductor thickness is larger than those of other conductors with r=2.5 and r=1.6.

Figure 10:
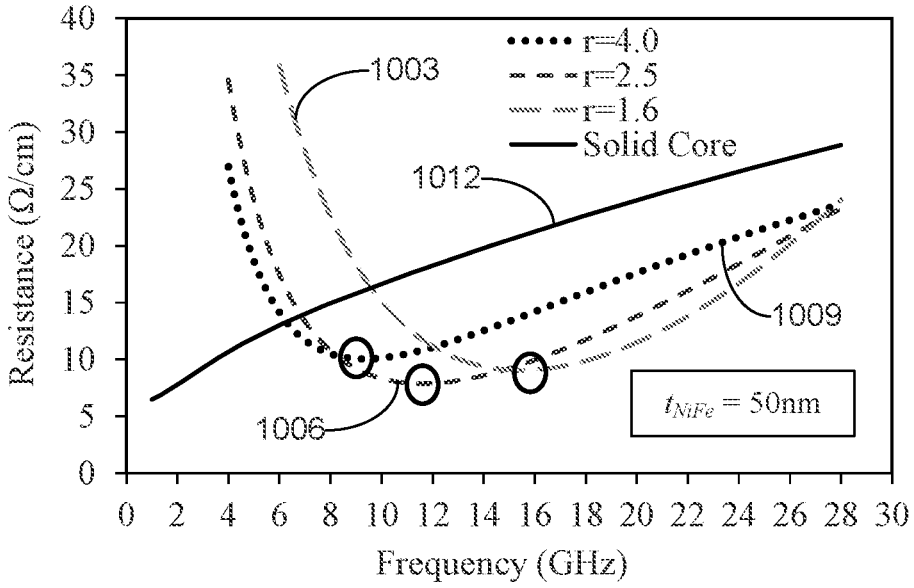

In FIG. 10, the same three ratios of the superlattice structure $r=t_{Cu}/t_{NiFe}$ were investigated with a constant $t_{NiFe}$=50 nm and a constant total conductor thickness (diameter). The overall diameter of the RSV structures and the solid conductor was kept the same (7 μm thick) in order to examine the effect on the conductor resistance. Curve 1003 corresponds to r=1.6, curve 1006 corresponds to r=2.5, and curve 1009 corresponds to r=4.0. Curve 1012 corresponds to a solid copper core conductor, for comparison. It can be seen in FIG. 10 that, while the indicated minimum values of the resistances are close to each other due to the same total conductor thickness for different Cu/NiFe thickness ratios, the conductor with the highest r (curve 1009) has the lowest minimum resistance. By properly selecting the thickness ratio of the conductors, it is possible to place the minimum resistance area in the frequency of operation range. In FIG. 10, minimum point frequencies of 9, 12 and 16 GHz were obtained by using the $r=t_{Cu}/t_{NiFe}$ ratio of 4.0, 2.5, and 1.6, respectively. At the lower frequency range (below 5 GHz), the resistance of the superlattice structure remains high because of the high permeability of the ferromagnetic layers makes the skin depth very thin (as based on equation (2)) and increases the ohmic loss.

Figure 11A:
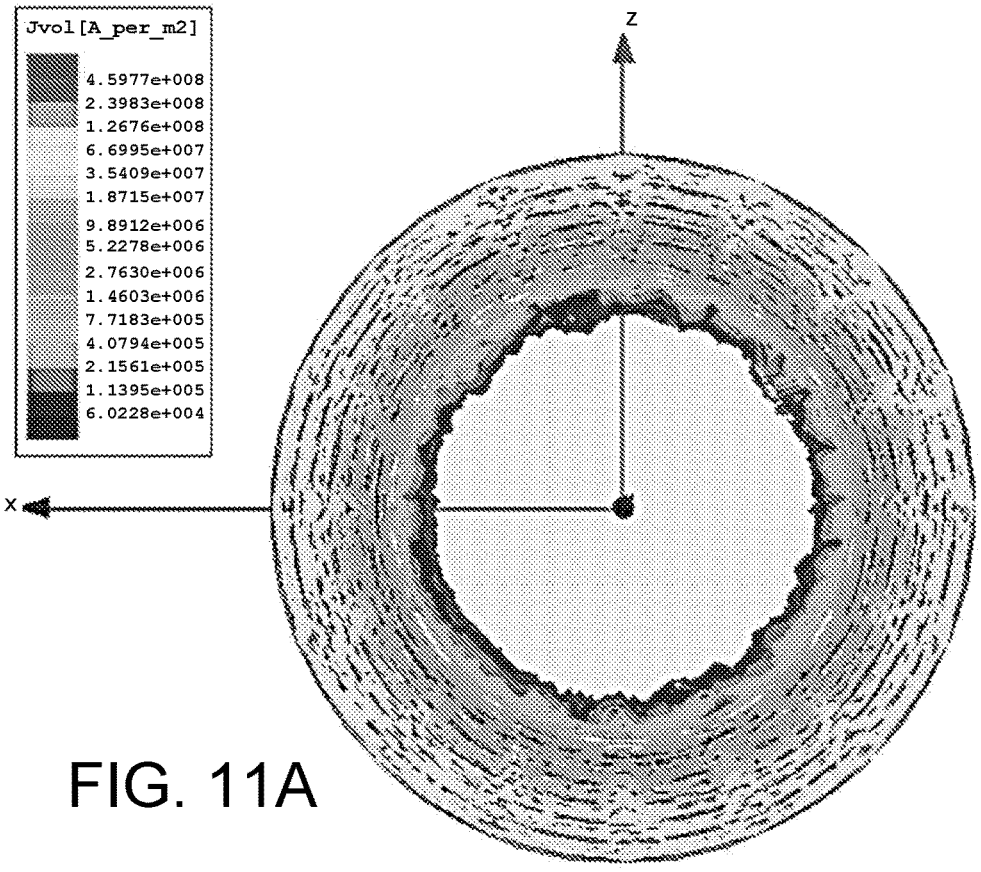
Figure 11B:
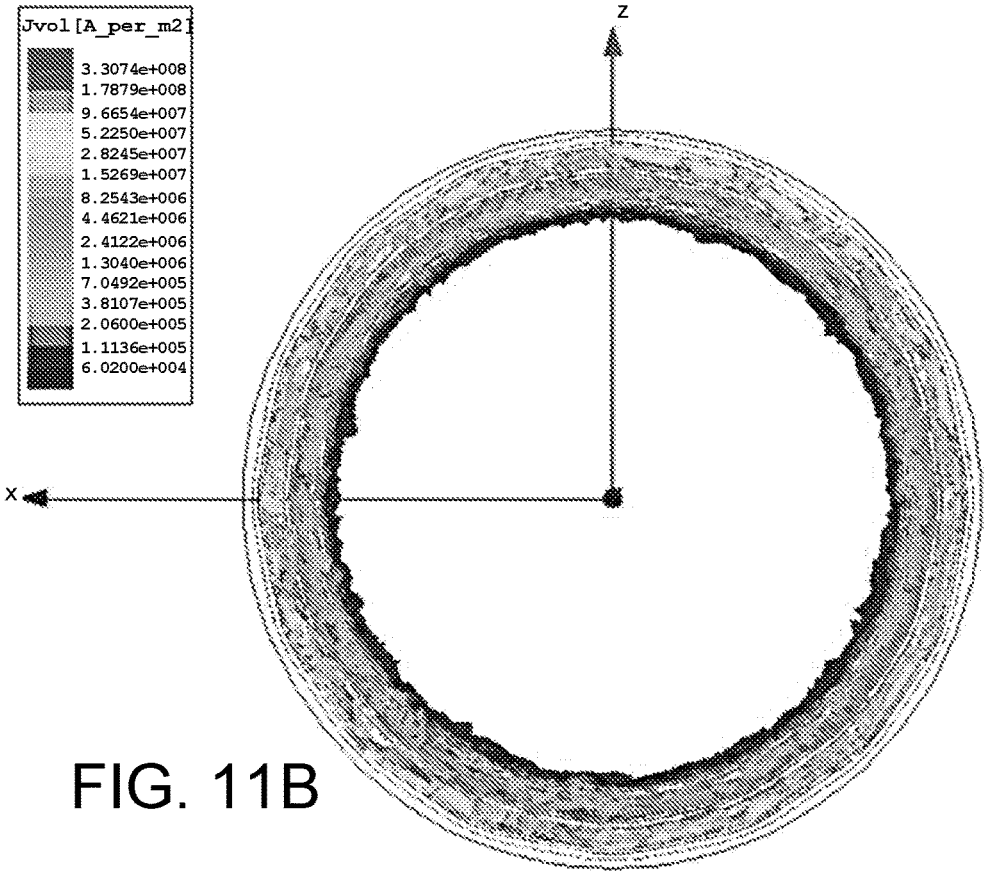

The eddy current canceling effect begins in the frequency range where the effective permeability approaches zero. After the operational frequency range, the resistance starts increasing normally with an order of $\sqrt{f}$. FIGS. 11A and 11B illustrate examples of the current distribution throughout a CRS conductor and a solid copper conductor based upon simulation results. FIG. 11A shows the current distribution throughout the volume of a CRS conductor with 21 layers, where the resistance has been minimized at a design frequency of 16 GHz. In comparison, FIG. 11B shows the current distribution throughout a solid core conductor where the current is confined in the outermost region of the conductor due to the skin effect. The same minimum and maximum current boundaries were set for both graphs.

Figure 12:
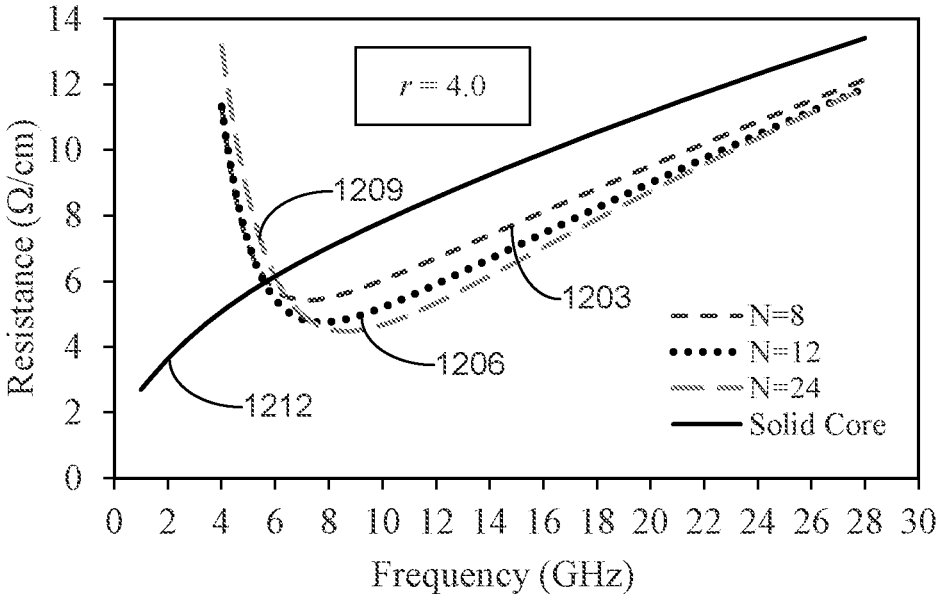

Referring next to FIG. 12, another set of simulations was performed using a 13 μm thick RSV where the thickness ratio ($r=t_{Cu}/t_{NiFe}$=4.0) was kept constant while the number of layers were changed to study the effect of the number of layers on the resistance spectra. The extracted resistance of the control solid-core Cu conductor has also been showed in FIG. 12 for the sake of comparison. Curve 1203 corresponds to N=8 ($t_{NiFe}$=150 nm, $t_{Cu}$=600 nm), curve 1206 corresponds to N=12 ($t_{NiFe}$=100 nm, $t_{Cu}$=400 nm), curve 1209 corresponds to N=24 ($t_{NiFe}$=50 nm, $t_{Cu}$=200 nm), and curve 1212 corresponds to the solid copper core conductor. By increasing the number of layers N while keeping the same ratio r, the frequency where the minimum resistance occurs, does not shift much. The higher number of thinner layers exhibits more effective macroscopic eddy current cancelling with the resultant resistance being smaller in the frequency range of operation.

Figure 13:
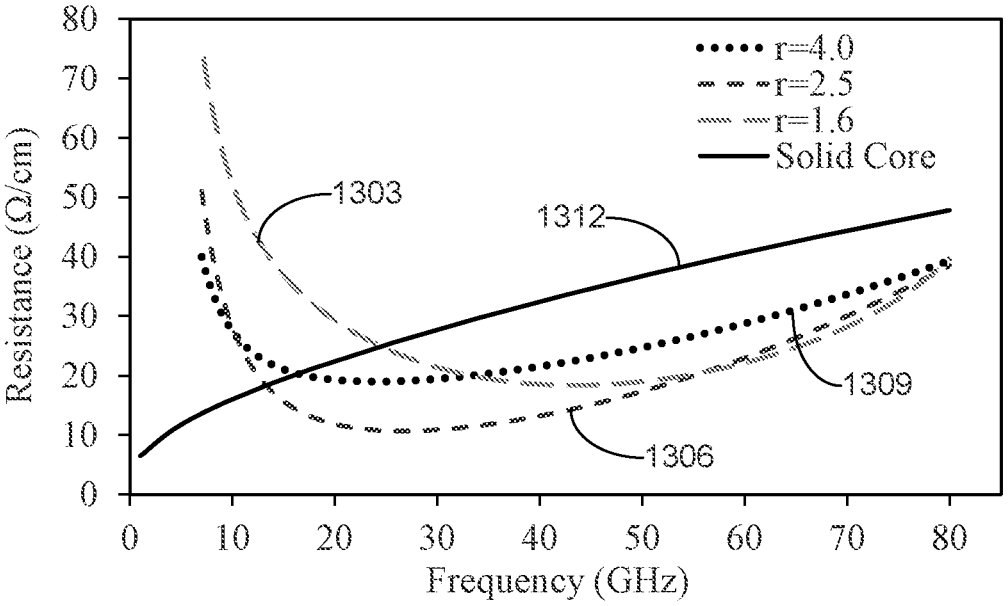

In order to utilize the RSV structures in higher frequencies, ferromagnetic materials with higher saturation magnetization and higher $f_{MR}$ frequency can be utilized. By using these ferromagnetic materials, the eddy current cancelling will occur at a higher frequency and the overall system can be designed for higher frequency ranges. FeCo is considered as a good candidate magnetic material that has a high $f_{MR}$ and can be deposited using standard processes allowing operation at higher frequencies (above 30 GHz). FIG. 13 depicts the simulation results of the resistance spectra of the RSV's consisting of Cu/FeCo layers that are performed up to 80 GHz. The overall diameter of the RSV structures and the solid conductor was kept the same (7 μm thick) with a constant $t_{FeCo}$=50 nm. Curve 1303 corresponds to r=1.6 (N=21, $t_{Cu}$=80 nm), curve 1306 corresponds to r=2.5 (N=16, $t_{Cu}$=125 nm), and curve 1309 corresponds to r=4.0 (N=11, $t_{Cu}$=200 nm). Curve 1312 corresponds to a solid copper core conductor, for comparison.

Figure 14:
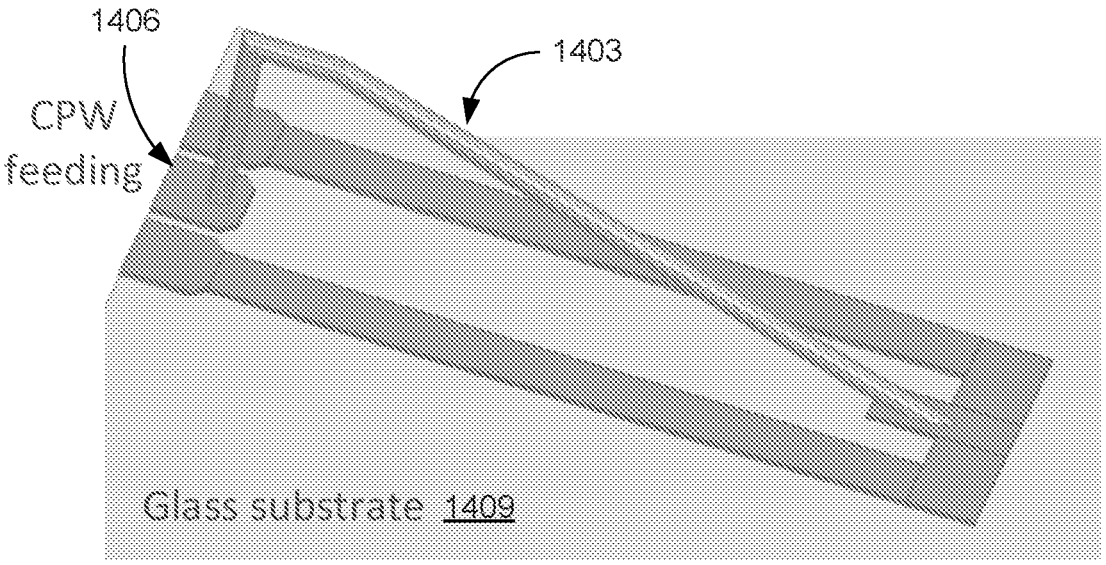
FIG. 14 is a schematic diagram of an example of a CRS conductor (or single turn inductor) in accordance with various embodiments of the present disclosure.

In order to verify the performance of the CRS and RSV structures, a CRS superlattice structure was fabricated on a radial conductor. Referring to FIG. 14, shown is a schematic diagram of an example of a CRS conductor 1403. The CRS conductor 1403 was fabricated using a radial gold wire that was implemented using a commercial wire bonder and a one-port coplanar waveguide (CPW) input 1406. The equivalent circuit of the CRS conductor 1403 is illustrated in FIG. 8 where port 1 is the CPW input 1406 and port 2 is grounded. The CRS conductors 1403 were fabricated on a glass substrate 1409 using a gold wire with a diameter of 28 μm as the structural core, followed by multiple-step electroplating of NiFe/Cu layers. Due to the radial shape of the structures, electroplating has been selected as the thin film deposition technique to ensure uniformity. The CRS conductors 1403 may also be considered single turn air-lifted inductors.

Figure 15:
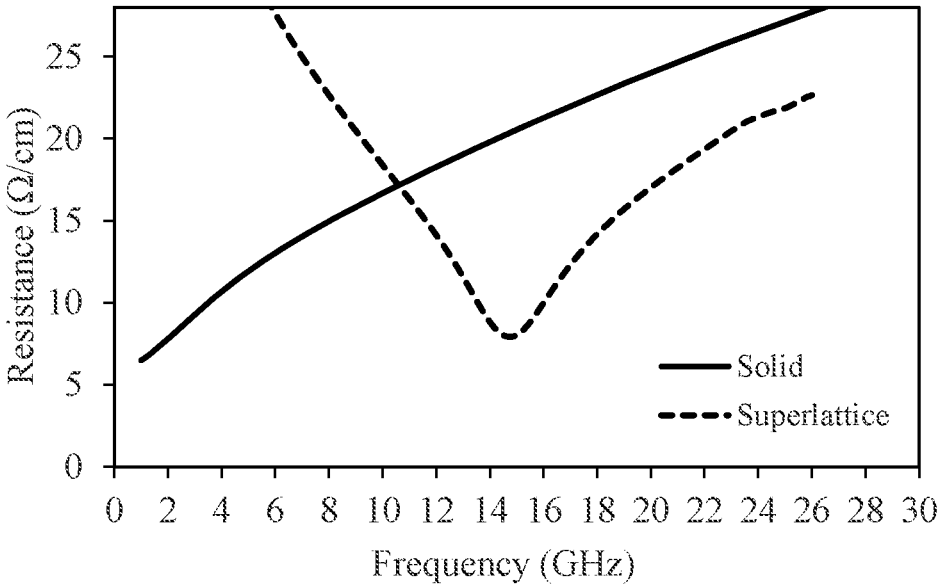
FIG. 15 is a graphical representation of an example of simulation results for the CRS conductor of FIG. 14 in accordance with various embodiments of the present disclosure.

The CRS conductors have been analyzed by performing the full-wave simulations using the high frequency structure simulator (HFSS, ANSYS Inc.) that illustrated the effectiveness of the CRS structure 100 (FIGS. 1A and 1B) for conductor loss reduction. A 10 μm-length unit cell of the CRS conductor included a solid core conductor 106*c* (FIGS. 1A and 1B) covered by laminated superlattice structures 103 and 106 (FIGS. 1A and 1B), where a ground plane was used underneath the structure, to allow propagation of transverse electromagnetic (TEM) waves. The lumped element equivalent circuit model of FIG. 8 was used to extract the conduction resistance of the conductor. FIG. 15 shows the resistance of the conductor unit cell here $r=t_{Cu}/t_{NiFe}=2.5$. The minimum resistance spectra occurs when $\mu_{eff}=0$ which will be satisfied when $\mu_{NiFe}=-2.5$ as expected from FIG. 2A. The simulation results reveal an ohmic loss reduction of about 3 times compared to the solid-core conductor at the target frequency of 15 GHz. For frequencies above 10 GHz, the resistivity of the superlattice structure falls below that of the solid-core conductor which leads to a relatively wide bandwidth where eddy current cancelling is effective.

Simulation results at 15 GHz for the current distribution throughout the CRS conductor 1403 were consistent with those shown in FIG. 11A. The current distribution for the solid core conductor made of copper was consistent with those shown in FIG. 11B. Due to the more uniform current distribution at the operation frequency in the CRS conductor 1403, the ohmic loss was significantly reduced.

Thin film permalloy and copper were used as the magnetic and non-magnetic metals, respectively, to create the CRS structure where both are electroplated using our in-house solution baths. The fabrication starts with a glass substrate 1409; after the deposition of the seed layers (Ti/Cu/Ti), the pads are patterned on the glass substrate 1409 followed by 10 μm electroplating of Cu. Then, the low-temperature gold wire bonding was immediately performed in order to avoid oxidation of the copper, which would require another metal layer on top of the copper for the sake of wire bonding. Electroplating was selected as the low cost, manufacturing method for the deposition of magnetic/non-magnetic nanoscopic thin films on the radial-shaped gold core conductors to ensure conformal coating. Most other processes including DC sputtering would be more expensive and may not work best for the radial-shape devices. Alternating layers of Cu and NiFe were electroplated on the gold wire core. After performing the multiple-step electroplating of NiFe/Cu, the CRS conductors 1403 are released by etching the seed layers. The table of FIG. 16 shows the utilized solution bath for the deposition of permalloy ($Ni_{80}Fe_{20}$) thin films.

FIGS. 17A-17C show pictures of the fabricated CRS conductors 1403 (or single-turn air-lifted CRS inductors). Arrays of conductors with different dimensions are shown in FIG. 17A. Conductors of different lengths but the same pad size were fabricated on the substrate. FIGS. 17B and 17C show CRS conductors of 1 mm and 2 mm lengths after electroplating. The backbone wire was implemented using a gold wire bonder. The solid core conductors were also fabricated using a single layer of copper with the same thickness as the superlattice multilayers.

Figure 18A:
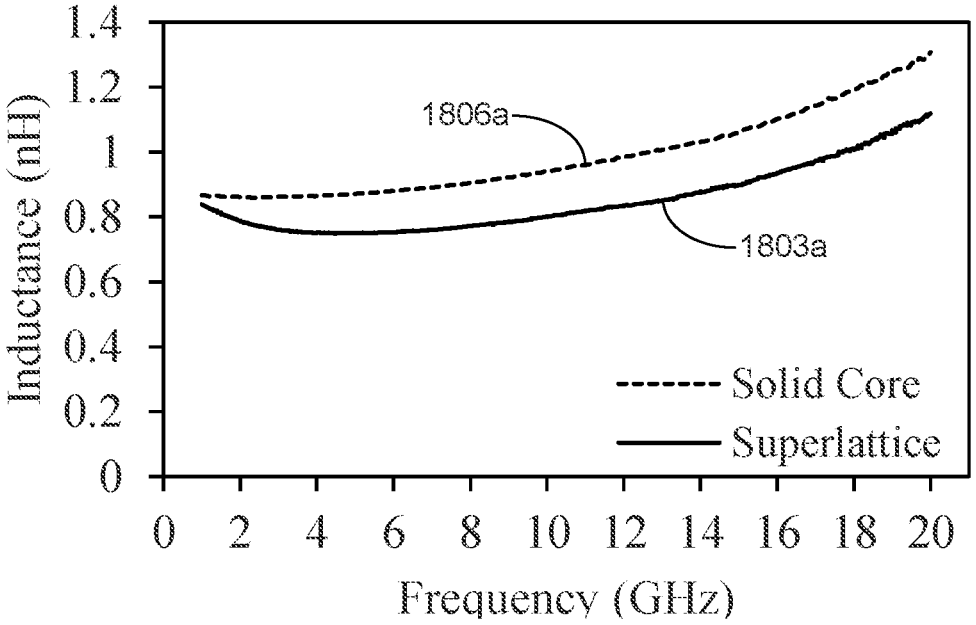
FIGS. 18A-20B are graphical representations of examples of measured results for the CRS conductors of FIGS. 17A-17C in accordance with various embodiments of the present disclosure.
Figure 18B:
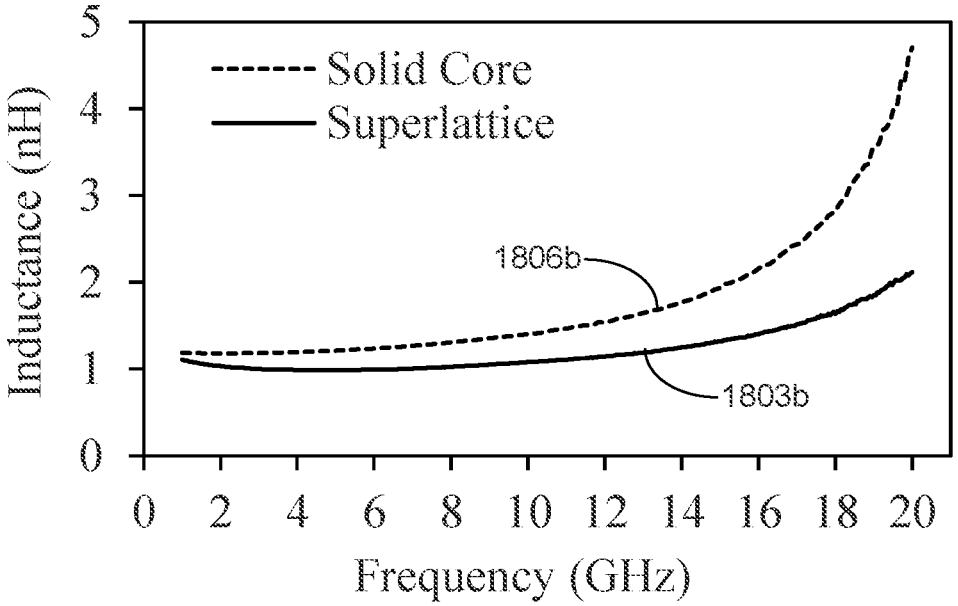

FIGS. 18A through 20B show the measurement results of the implemented CRS conductors (or inductors) 1403 where regular (solid core) wire conductors are also measured as control devices for comparison. The measurement results of two sets of CRS conductors 1403 with different lengths but a conformal deposition of 21 layers of NiFe/Cu (160 nm/400 nm) layers are presented. Atomic layer deposition can also be used to form the layers. This can provide better conformality and controllability compared to electroplating. Multiple Ni and Cu targets facing the substrate inside the electroplating bath were used for a uniform deposition of both NiFe and Cu around the radial-shape conductors. The inductance and resistance of the CRS conductors 1403 were determined after analyzing the one-port Y-parameters. Referring to FIGS. 18A and 18B, the measured inductance values of the 1 mm and 2 mm CRS conductors (curves 1803*a* and 1803*b*), respectively, and solid-core conductors (curves 1806*a* and 1806*b*) were graphed. The inductance values of both are in the same range while the solid-core conductors (curves 1806) show slightly higher inductance values compared to CRS conductors (curves 1803). The distance between the probe and the ground was 1 mm for FIG. 18A and 2 mm for FIG. 18B.

Figure 19A:
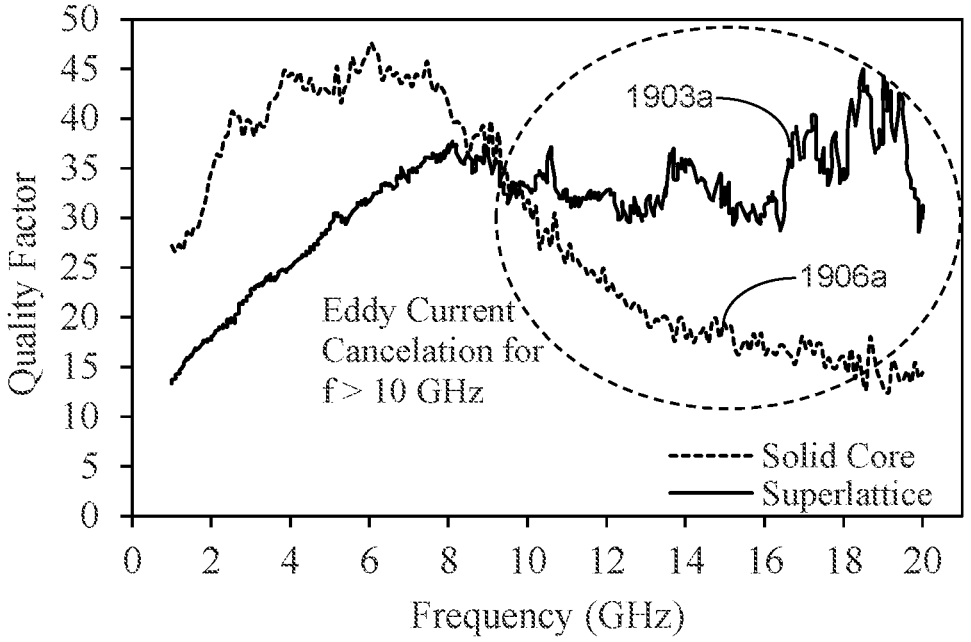
Figure 19B:
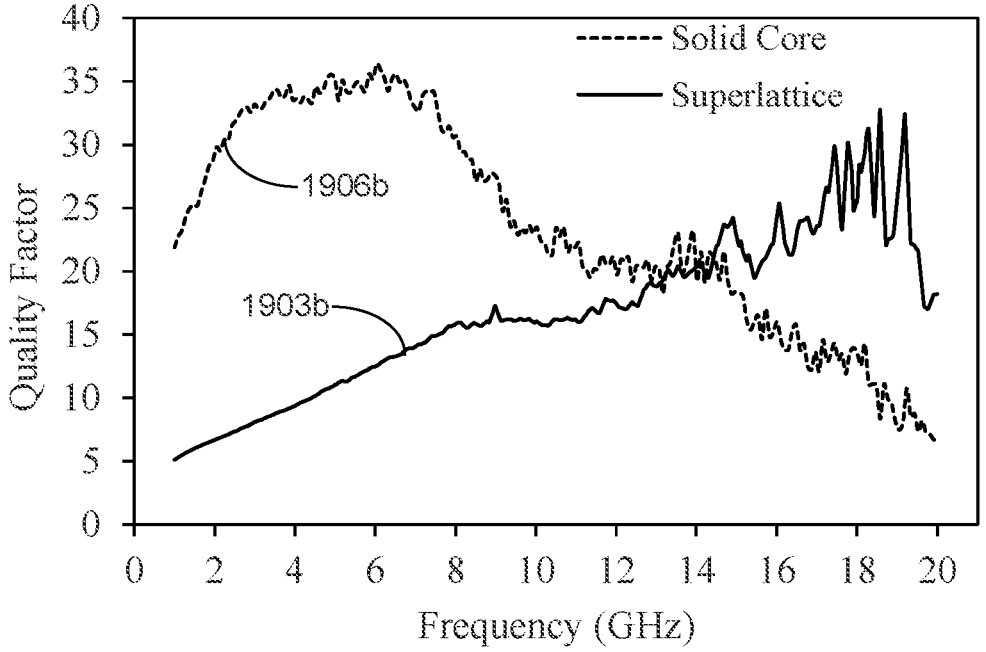

FIGS. 19A and 19B show the measured quality factor (Q-factor) of the implemented CRS conductors. The measured Q-factors of the solid-wire (curves 1906*a* and 1906*b*) and of the 1 mm long superlattice-wire conductors (or inductors) (curve 1903*a*) are shown in FIG. 19A and of the 2 mm long superlattice-wire conductors (or inductors) (curve 1903*b*) are shown in FIG. 19B. As predicted in FIG. 15, the resistance of the CRS conductor 1403 is lower than that of the solid-wire one in the range of 10-24 GHz. The ohmic resistance of the single layer copper constantly increases with the frequency due to the skin effect. As shown in FIG. 15, the ohmic resistance of the CRS conductors (or inductors) 1403 is higher than that of the solid-wire conductors in frequencies below 10 GHz; however, it starts to fall below the resistance of solid-wire inductors for frequencies above 10 GHz.

A higher Q-factor is achieved for the 1 mm CRS conductors at 10-20 GHz in FIG. 19A and for the 2 mm CRS conductors at 14-20 GHz in FIG. 19B, illustrating the effectiveness of eddy current cancellation for the CRS conductors 1403. Using single-layer solid-wire devices, the Q-factor continuously decreases for the frequencies above 10 GHz. Therefore, the Q-factor of the CRS inductors is higher compared to that of the solid-wire inductors in the operational frequency range of 10 GHz<f<20 GHz. Therefore, the CRS conductor provides a solution to the high resistivity and low Q-factor of RF passive devices originating from the skin effect. By changing the thickness ratio $r=/t_{Cu}/t_{NiFe}$, the minimum resistance spectra point can be tuned, making it possible to avoid the skin effect problem and design low loss passive devices operating in an desired frequency range.

Figure 20A:
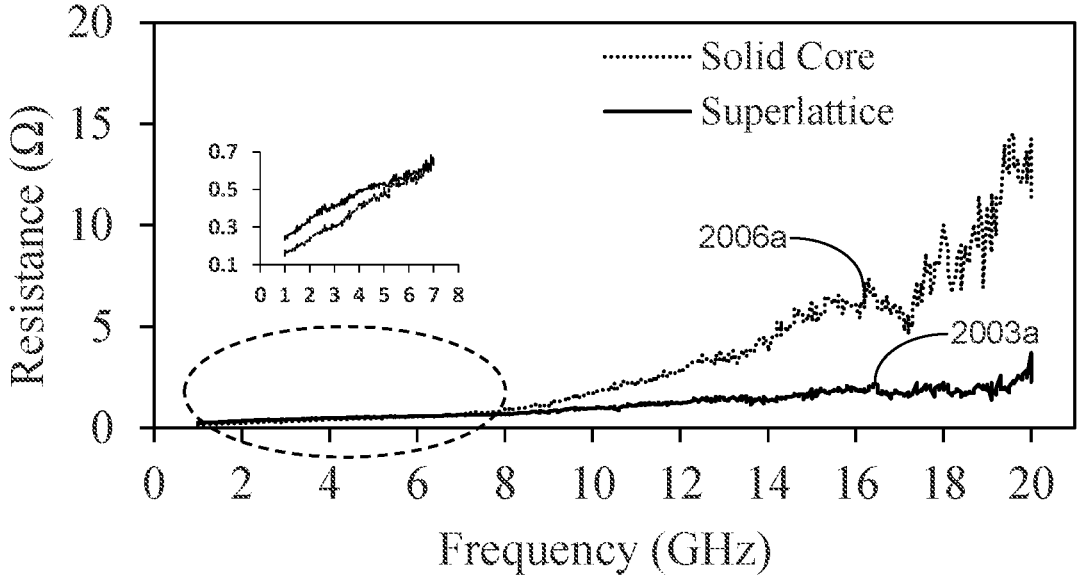
Figure 20B:
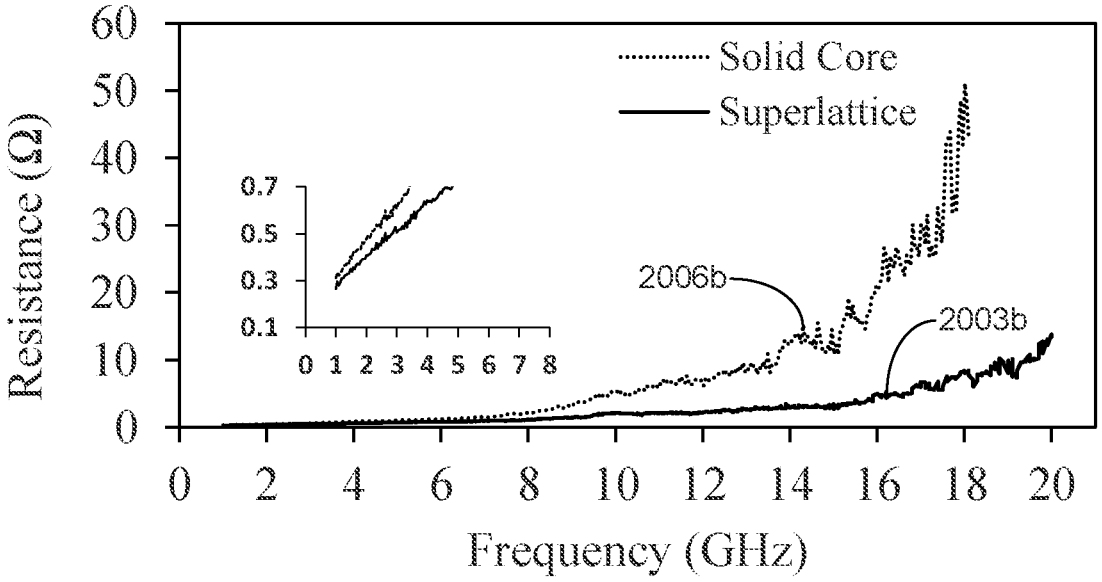

FIGS. 20A and 20B show a comparison of the measured resistance of the 1 mm CRS conductors (curve 2003*a*) and 2 mm CRS conductors (curve 2003*b*), respectively. The resistance of the solid core conductor is provided as curves 2006*a* and 2006*b* for comparison. The CRS conductors 1403 have higher resistance in low frequency range due to the high permeability of NiFe thin films in that frequency range, which makes the skin depth smaller (see equation (2)) and increases the ohmic loss. However, as the frequency increases, the total CRS resistance is kept below that of solid wire devices and a wide-band of operation is achieved.

Figure 21A:
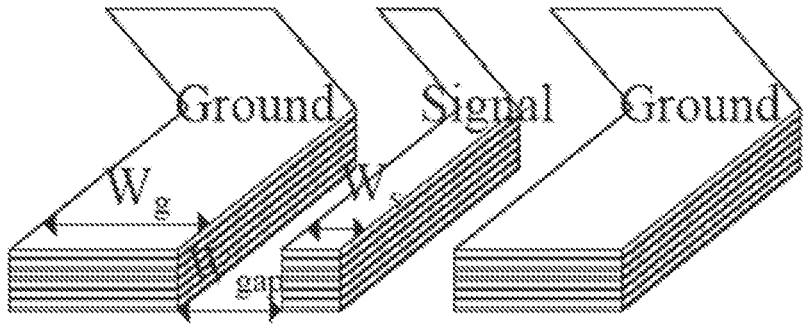
FIGS. 21A and 21B are schematic diagrams of an example of a planar superlattice conductor comprising alternating layers of copper and nickel (Cu/Ni) in accordance with various embodiments of the present disclosure.
Figure 21B:
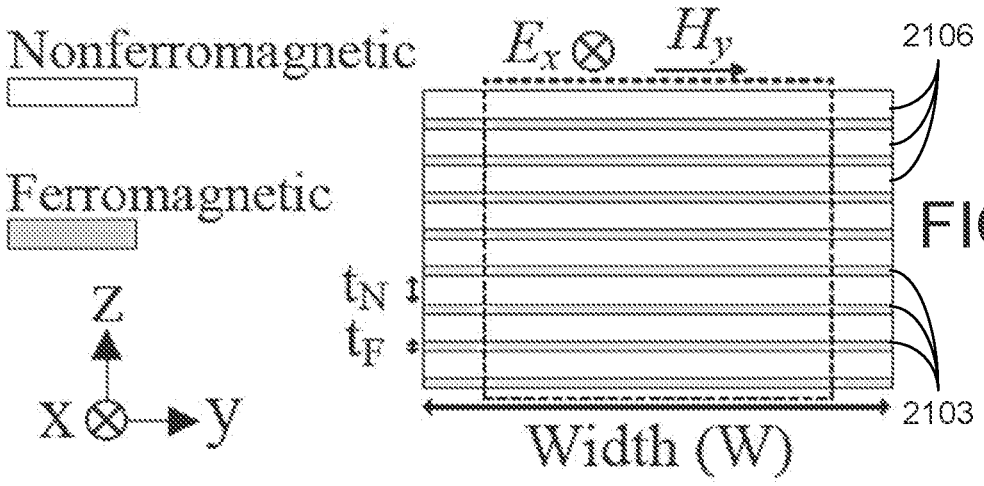

FIG. 21A graphically illustrates an example of a CPW transmission line employing a planar multi-layer superlattice conductor architecture. FIG. 21B depicts the cross section of the planar multi-layer superlattice conductor in a Cartesian coordinate system, where ferromagnetic thin films 2103 with negative permeability in a GHz range of interest are used to cancel the eddy currents produced by the non-ferromagnetic material 2106 with positive permeability ($\mu_N \approx 1$), thereby resulting in suppression of the skin effect and low ohmic loss.

While uniform field distributions are assumed inside a segment of the conductor (as shown), the field distribution will be disturbed by the fringing effect at the edges of the planar conductor and the eddy current cancelling will not be much effective in those regions. By using a wider conductor, the relative contribution of the edges can be reduced. Full-wave simulations using a high frequency structure simulator (HFSS, v. 15.0, ANSYS Inc.) were performed to study the dimension effects of the multi-layer conductors.

Figure 21C:
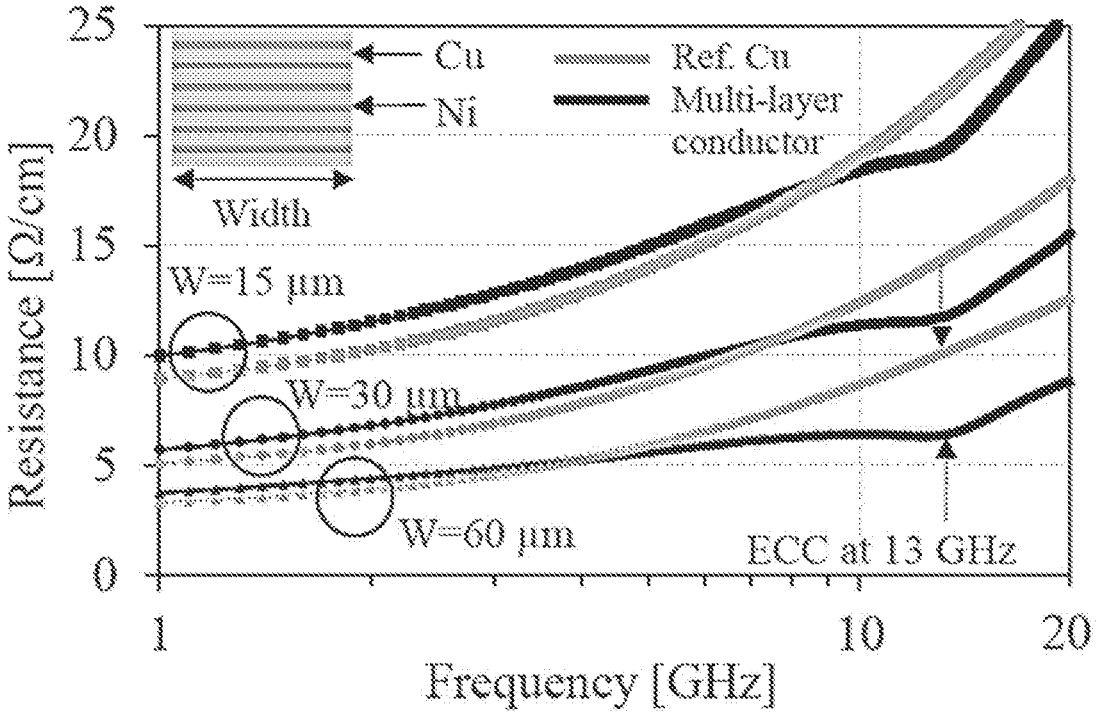
FIG. 21C illustrates plots of the resistance spectra vs. frequency of the planar superlattice conductor of FIGS. 21A and 21B in accordance with various embodiments of the present disclosure.

Referring to FIG. 21C, shown are simulation results of a unit-cell of multi-layer conductors with widths of 15, 30 and 60 μm and a given thickness of $t_{Cu}$=150 nm and $t_{Ni}$=25 nm. FIG. 21C plots the resistance spectra vs. frequency in the microwave region. $t_N$ and $t_F$ denote the thickness of the non-ferromagnetic and ferromagnetic thin film layers, respectively. The bold lines illustrate the resistance of the multi-layer conductors where the gray lines show that of the corresponding reference solid Cu conductors for the conductor widths of W=15, 30, and 60 μm. The loss reduction is the difference between the RF resistance of the multi-layer and the reference solid conductors divided by the resistance of the reference conductor in percentage. For W=60 μm, a loss reduction of more than 50% was achieved where the loss reduction percentage will be diminished for conductors with smaller widths. For conductors that are wider than 60 μm, the loss reduction percentage may not depend much on the conductor's width and the effect of fringing fields may be ignored and other design parameters can dominate for the multi-layer conductor.

Figure 22A:
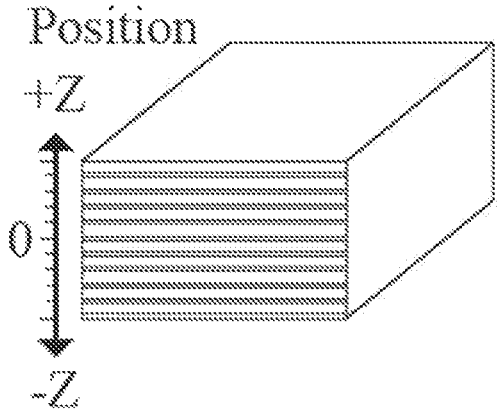
FIGS. 22A-22C illustrate current distributions in examples of planar superlattice conductors of FIGS. 21A and 21B in accordance with various embodiments of the present disclosure.

Another parameter affecting the performance of the multi-layer conductors is the thickness of the individual thin films. FIG. 22A illustrates a comparison of two multi-layer conductors with the same thickness ratio of $t_{Cu}/t_{Ni}$=6, but different film thicknesses, when operating at the same ECC frequency. FIG. 22A depicts a first conductor 2203 with alternating Cu/Ni layers having thicknesses of $t_{Cu}$=150 nm and $t_{Ni}$=25 nm (total conductor thickness of 1.75 μm) and FIG. 22B depicts a second conductor 2206 having thicknesses of $t_{Cu}$=600 nm and $t_{Ni}$=100 nm (total conductor thickness of 7 μm).

Figure 22B:
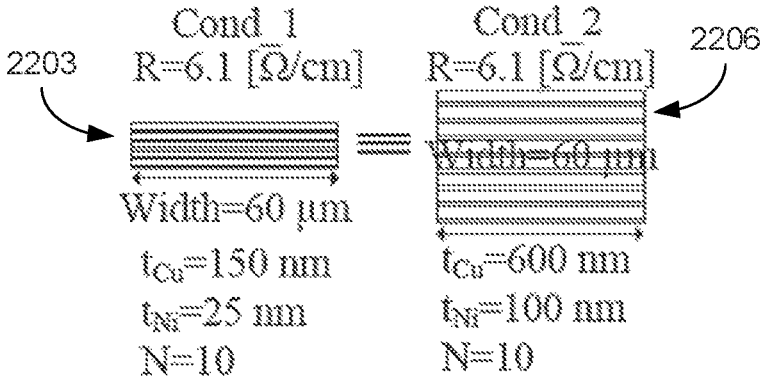
Figure 22B:
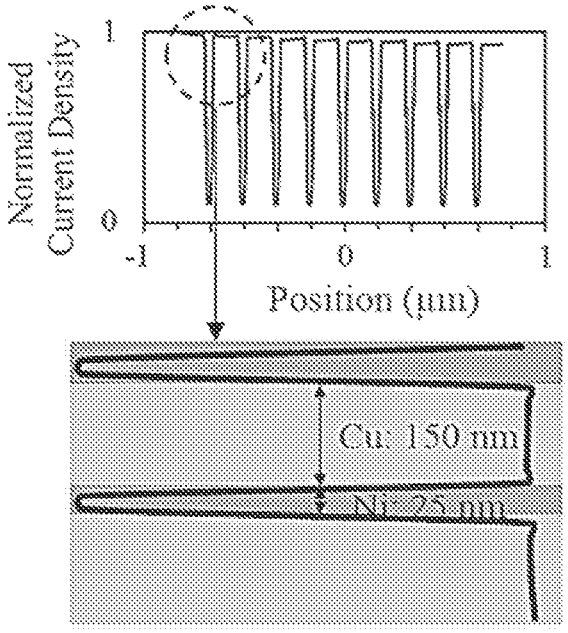
Figure 22C:
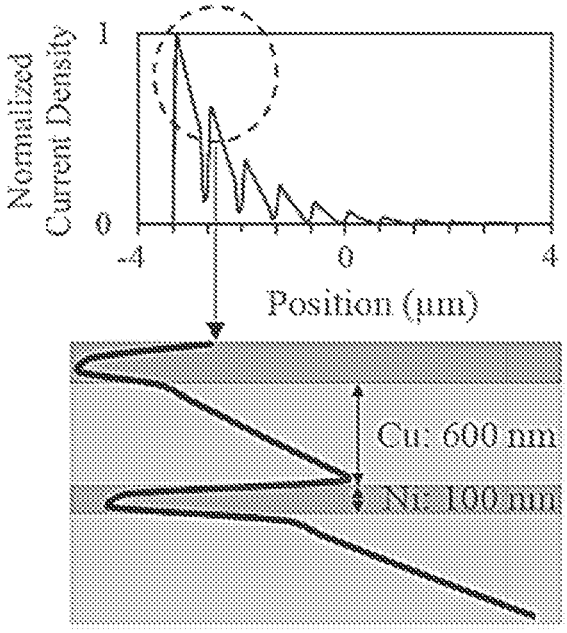

FIGS. 22B and 22C illustrate the current distribution in the volume of two multi-layer conductors 2203 and 2206, respectively, at an ECC frequency of 13 GHz. The extracted current distribution through the thickness of the conductor is shown over a cross-sectional view. For the conductor 2203 of FIG. 22B, the current will be fully uniform inside the conductor with a good microscopic ECC effect. For the conductor 2206 of FIG. 22C, the ECC effect and the ohmic loss reduction compared to its solid reference counterpart at the same operation frequency of 13 GHz can both exist, however the advantages will be limited because the current is quickly degraded in the Cu layers whose thickness is thicker than its skin depth. Thus, the ECC effect is not fully exploited. Therefore, the conductor 2203 exhibits a similar RF resistance value as the conductor 2206, however with a thickness that is more than 4 times smaller.

High performance transmission lines and interconnects were fabricated using the multi-layer superlattice conductors to experimentally verify their performance, followed by magnetic and RF characterizations. A low-loss glass substrate coated with a 30 μm thick Benzocyclobutene (BCB, Cyclotene 4026-46; Dow Chemical, $\varepsilon_r$=2.65, tan δ=0.002) was used as the low dielectric loss medium with highly uniform surface for device implementation. Ten (10) layers of Cu/Ni (150 nm/25 nm) thin films were alternatingly deposited by DC/RF sputtering (Kurt J. Lesker CMS-18) and the final devices were released using a lift-off process.

Figure 23A:
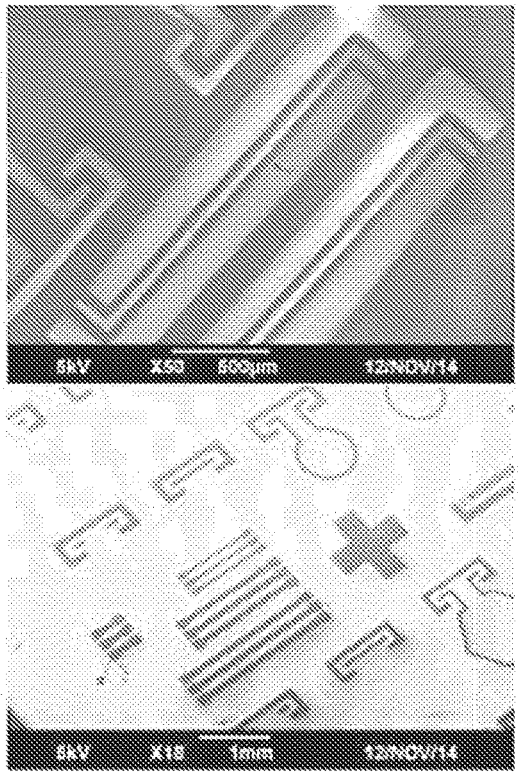
FIG. 23A are images of fabricated Cu/Ni planar superlattice transmission lines and interconnects in accordance with various embodiments of the present disclosure.
Figure 23B:
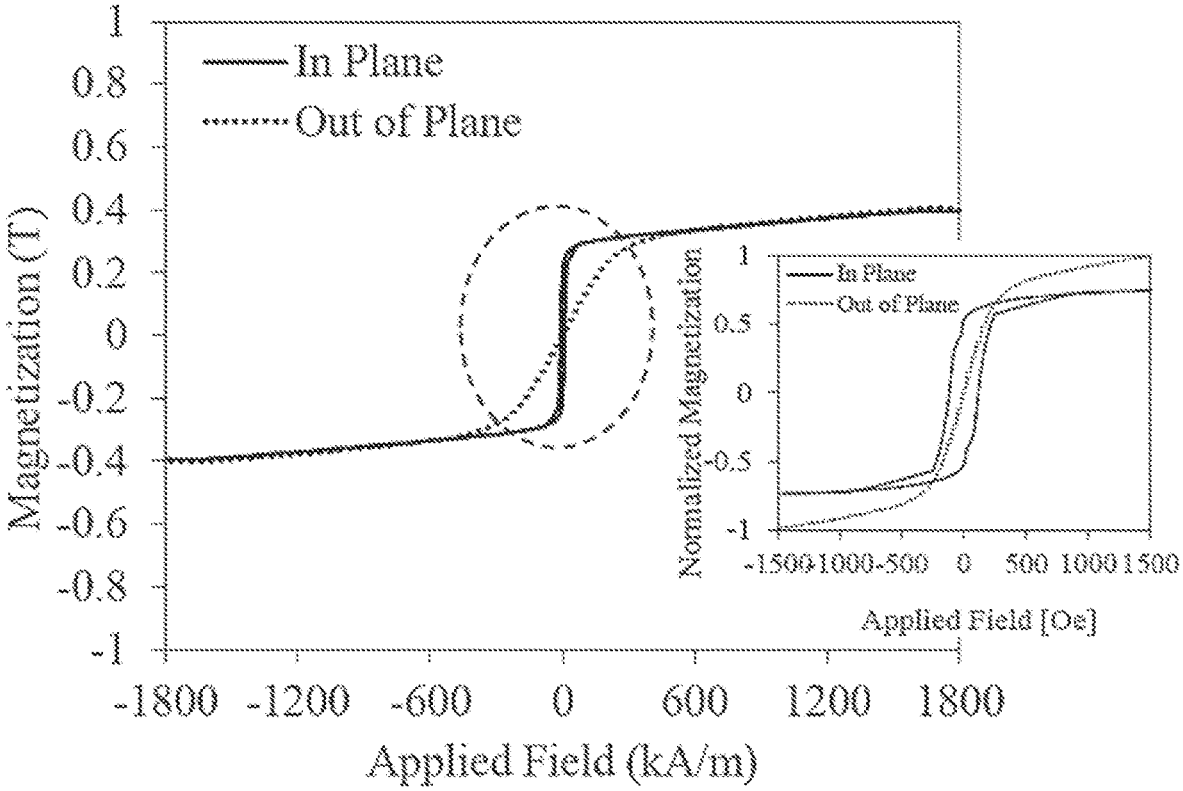
FIG. 23B illustrates examples of magnetic characterization of Cu/Ni superlattice conductors in accordance with various embodiments of the present disclosure.

FIG. 23A shows scanning electron microscope (SEM) images of the fabricated transmission lines and interconnects of various dimensions and shapes with coplanar waveguide (CPW) probing pads. FIG. 23B illustrates an example of the magnetic characterization of the multi-layer Cu/Ni conductors with a dimension of 3 mm×3 mm. FIG. 23B shows an in-plane anisotropy field of 150 Oe, an out-of-plane anisotropy field of less than 5 Oe, and a magnetization saturation of 0.4 T from vibrating sample magnetometer (VSM) measurements (ADE Technologies EV9 with a maximum applied field of ±1800 kA $m^{-1}$). This large contrast between the in-plane and out-of-plane anisotropy field of Ni allows implementing wider self-magnetic-biased conductors without any distortion of the magnetic alignment on the easy axis.

Figure 24A:
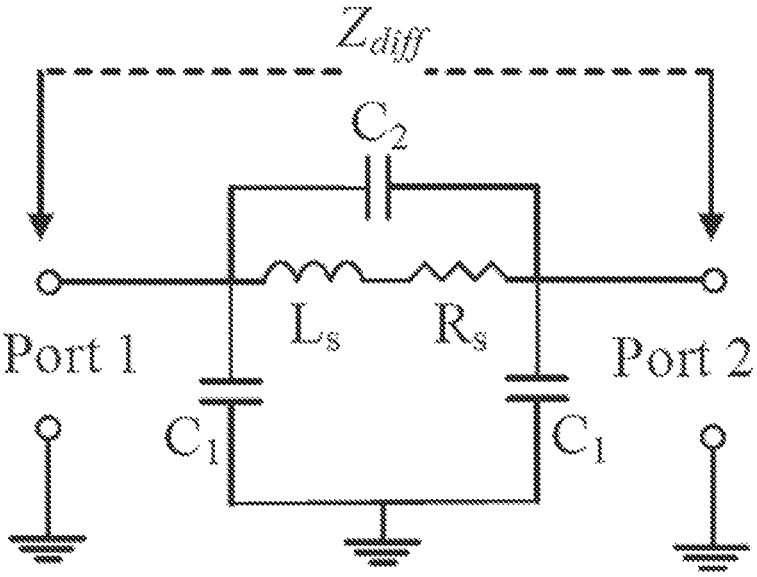
FIGS. 24A-24C illustrates measurement characterization of fabricated Cu/Ni superlattice conductors in accordance with various embodiments of the present disclosure.
Figure 24B:
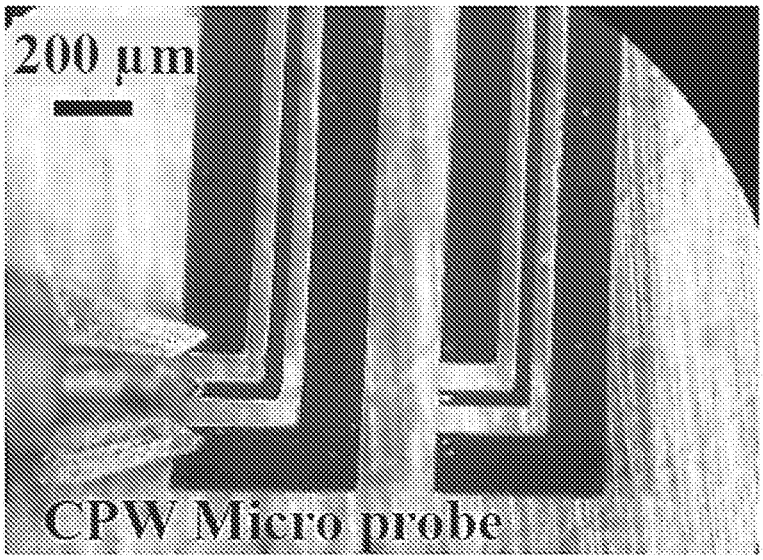

The RF measurements were performed using a vector network analyzer (E5071C, Agilent Inc.) after standard short-open-load-through (SOLT) two-port calibration between 10 MHz and 20 GHz. The resistance of the fabricated transmission lines was extracted from the two-port scattering parameters. FIG. 24A schematically represents the ohmic resistance extraction method. FIG. 24B is an image of the measurement setup. The contact resistance of the measurement probes was calculated as the difference between the minimum measured frequency (10 MHz) and the DC resistance of the conductor to be 1.2Ω, which was deducted from the measured resistance raw data.

Figures 24C, 25:
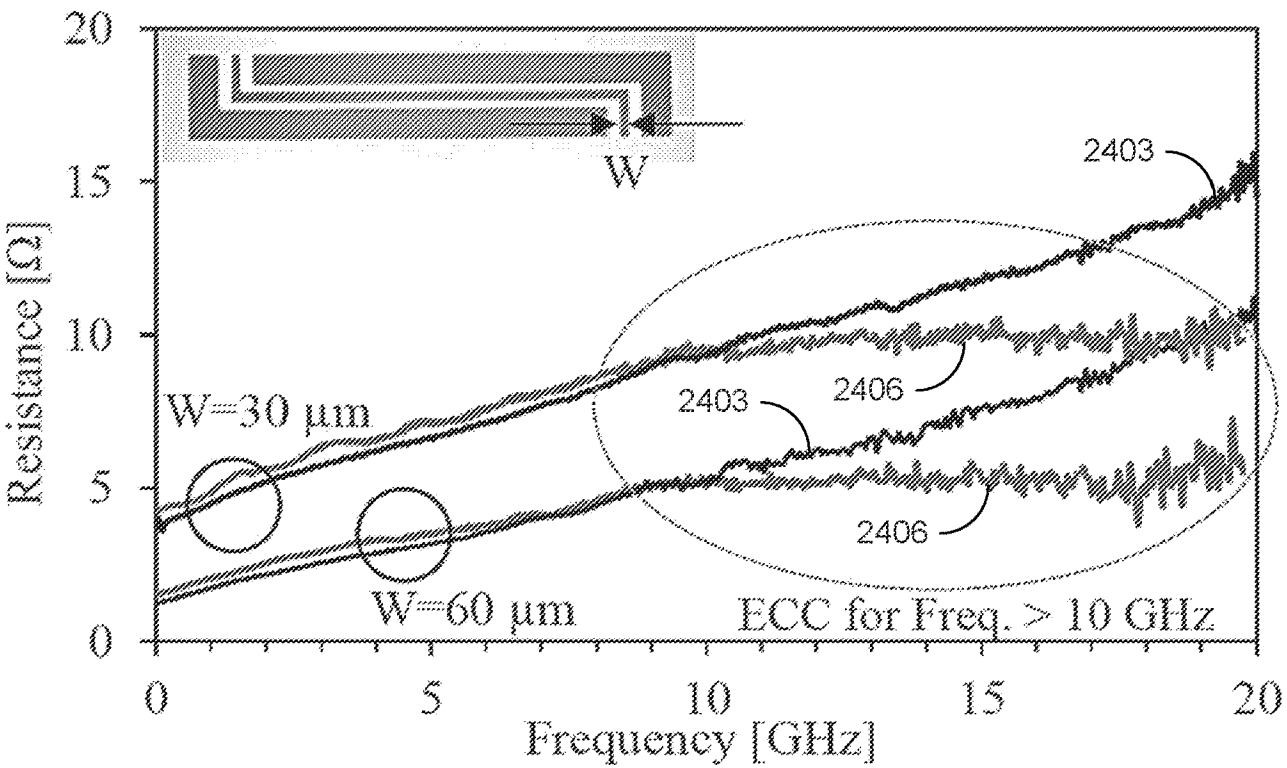
FIG. 25 is a table illustrating a comparison of Cu/Ni planar superlattice conductors in accordance with various embodiments of the present disclosure.

FIG. 24B shows the micrograph of the CPW microprobes, ground-signal-ground (GSG) with 150 μm pitch, landed on the device under test and FIG. 24C shows the measurement results of transmission lines with widths of W=30 μm and 60 μm. Plotted lines 2403 show the corresponding reference Cu conductors and the plotted lines 2406 show the measurement results. For frequencies above 10 GHz up to 20 GHz, the resistance of the multi-layer CPW lines falls below the resistance of the reference Cu conductors due to the ECC effect. At frequencies above 13 GHz, there is some deviation between the measurement and simulation results. The magnetic permeability value of Ni used for the simulation was extracted from the LLG equation (1). The magnetic permeability of Ni may not accurately represent the real permeability of Ni in the 13 to 20 GHz range, where the magnitude of the relative magnetic permeability is much smaller than unity. This effect may be favorably used for conductors with reduced RF loss in a wider frequency range than initially designed.

Comparison of the fabricated superlattice transmission lines with the corresponding reference Cu conductors are made in the table of FIG. 25. The table summarizes the comparison of the state-of-the-art conductors that utilize various ferromagnetic materials in a multi-layer structure to reduce the RF conductor loss. The utilized figure of merit (FoM) is defined as frequency/(normalized resistance x cross section area) or frequency/effective resistivity, where normalized resistance is the resistance of the conductor divided by its length, the cross section area (=t×w) where "t" is the total thickness of the conductor and "w" is its width. The conductors with a thickness in the order of one skin depth at the operation frequencies will be limited by the self-confined eddy currents and the current penetration through the volume of the conductor will exponentially vanished beyond one skin depth. As a result, the maximum loss reduction percentage and the highest FoM can be achieved using Cu/Ni multi-layer conductors with wider and thinner films. The Cu/Ni structures exhibit a FoM that is more than three times those of previously reported Cu/ferromagnetic alloy based devices. In overall, the Cu/Ni superlattice conductors could be exploited for next generation RF circuits and systems in the Ku, K, and Ka bands.

Figure 26A:
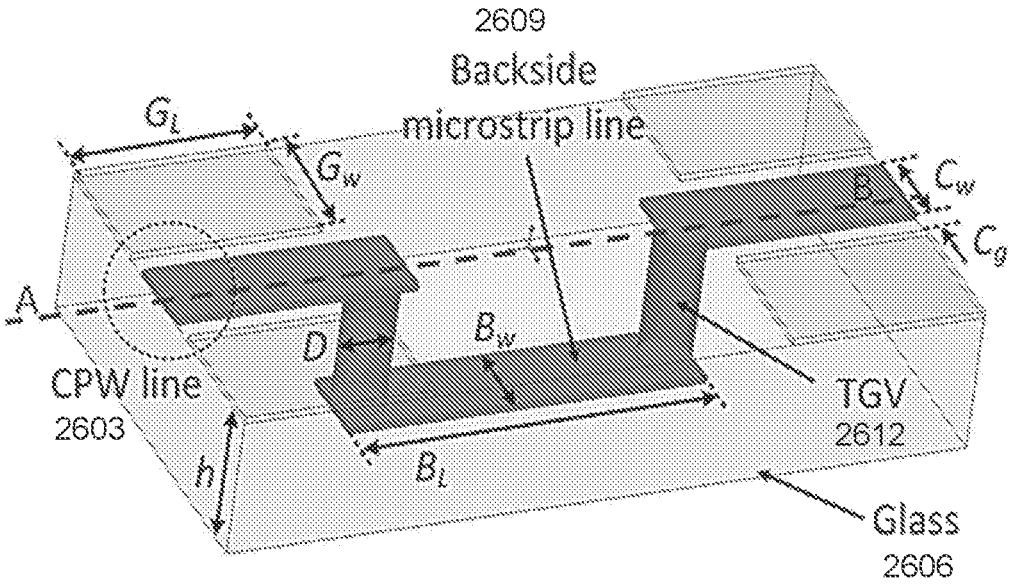
FIGS. 26A and 26B graphically illustrate an example of cylindrical radial superlattice (CRS) vias being used in combination with planar superlattice structures in accordance with various embodiments of the present disclosure.
Figure 26B:
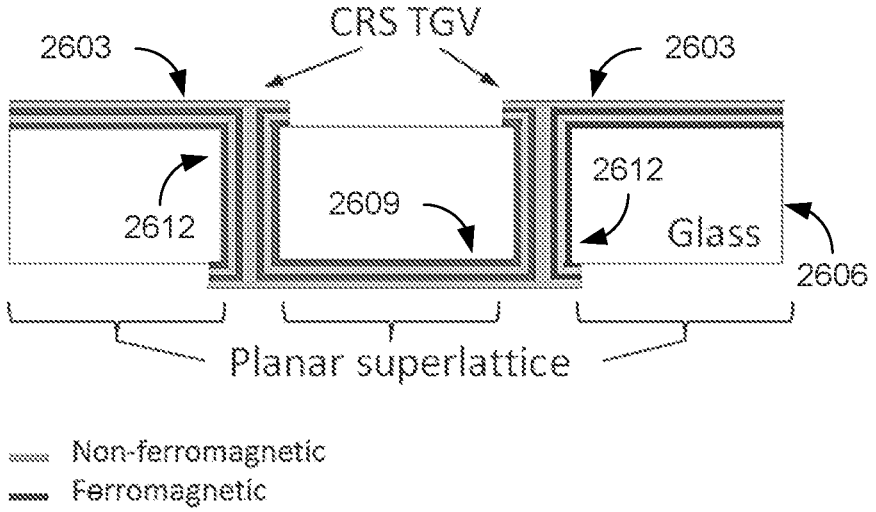

Referring next to FIGS. 26A and 26B, shown are perspective and cross-sectional views of schematic representations of an example of cylindrical radial superlattice (CRS) vias being used in combination with planar superlattice structures such as coplanar waveguide (CPW) transmission lines and/or probing pads. The example of FIGS. 26A and 26B can include CPW probing pads 2603 on top of a glass substrate 2606, that are coupled to a microstrip line 2609 on the back by through glass vias (TGVs) 2612. The TGV interconnects 2612 can be made of CRS conductors and the lateral interconnects 2603/2609 can be made of planar superlattice and/or solid conductors.

Figures 27, 28:
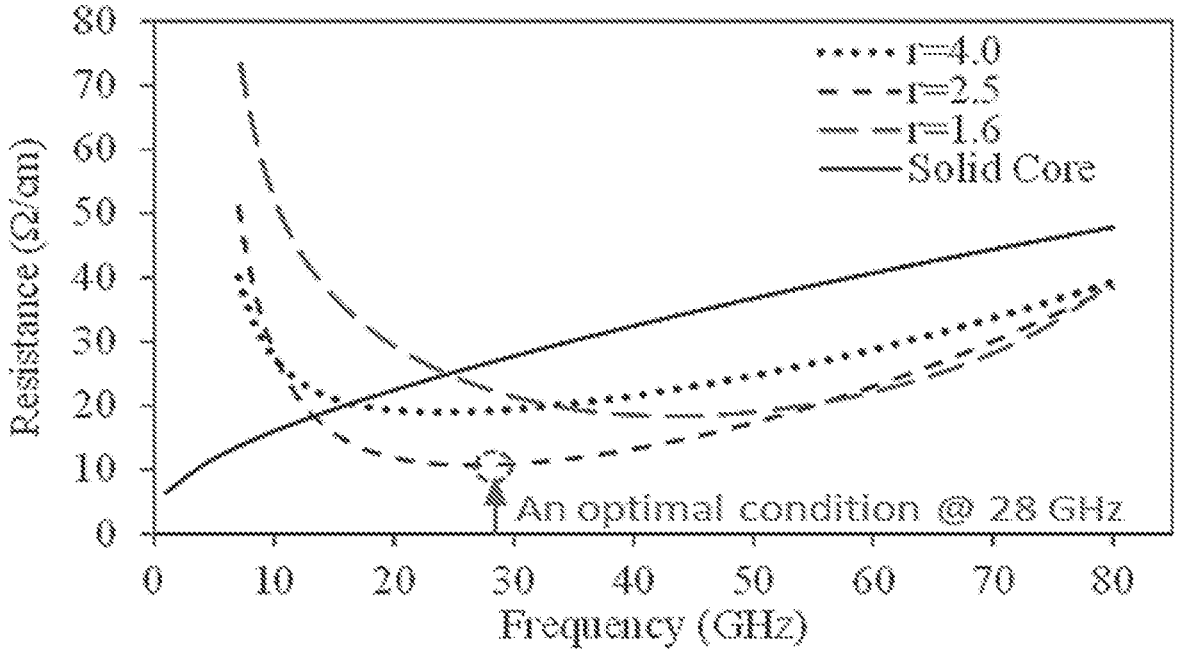
FIG. 27 is a table listing examples of magnetic properties of ferromagnetic materials in accordance with various embodiments of the present disclosure.
FIG. 28 illustrates simulation results for a CRS conductor structure in accordance with various embodiments of the present disclosure.

In the superlattice conductors having non-ferromagnetic and ferromagnetic metallic layers, the main role of the non-ferromagnetic layer is to provide high electrical conductivity, for which copper (Cu), aluminum (Al), silver (Ag), and gold (Au) can be good candidates. Cu is preferred if electrodeposition is used for fabrication and process cost is concerned. As for the ferromagnetic material, it provides negative magnetic permeability for eddy current canceling, and the frequency range of the negative magnetic permeability of the material is considered. The target frequency should be placed between the ferromagnetic resonance frequency ($f_{MR}$) and the anti-resonance frequency ($f_{AR}$) of the non-ferromagnetic material. For example, with a target frequency of 28 GHz, the ferromagnetic material $Ni_{80}Fe_{20}$ is not a good candidate as it's $f_{AR}$ is approximately 28 GHz. The table of FIG. 27 summarizes the magnetic properties (saturation magnetization and the anti-resonance frequency) of various ferromagnetic materials, which were calculated using the LLG equation (1). For a target frequency of 28 GHz, $Ni_{50}Fe_{50}$, $Co_{50}Fe_{50}$, FeCoB, FeCoSiN, Fe, Ni, and 3% SiFe are good candidates.

FIG. 28 shows simulation results performed up to 80 GHz for a 7 μm thick Cu/FeCoSiN CRS conductor structure with $t_{FeCoSiN}$=50 nm for three cases: (a) r=1.6, N=21, $t_{Cu}$=80 nm, (b) r=2.5, N=16, $t_{Cu}$=125 nm, and (c) r=4.0, N=11, $t_{Cu}$=200 nm. Once a material is selected, the thickness ratio between the non-ferromagnetic material and the ferromagnetic material can be used to determine the minimum resistance point. For instance, when FeCoSiN is 50 nm thick and Cu is 125 nm thick with total 16 layers, an optimal low resistance is obtained at 28 GHz. Numerous combinations of the material and thickness selections for low RF resistance are possible.

It should be noted that not only the thickness ratio but also the absolute thickness value affects the loss. The thickness of the Cu layer should be smaller than the skin depth at the operational frequency to avoid self-confined eddy current loss. The resistance can decrease as the total number of layers is increased with the thickness of each layer much smaller than the skin depth. However, the thinner the metal layers, the harder to achieve uniform thin film layers, especially for high aspect ratio via structures. Therefore, the implementation of CRS vias needs to be carried out utilizing good conformal fabrication schemes.

Figure 29:
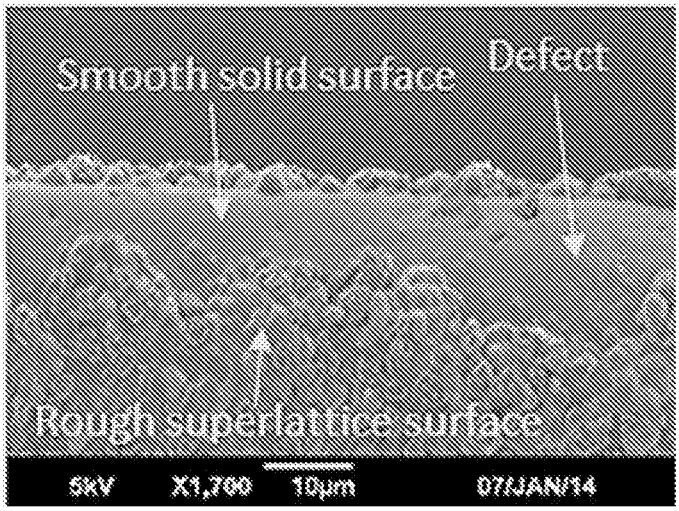
FIG. 29 is an image illustrating surface roughness of a conductor surface and defects formed during thin film deposition in accordance with various embodiments of the present disclosure.

As a metallization approach, electroplating enables conformal metal coating on the cylindrical micro wires. Other conformal deposition such as atomic layer deposition can also be used to form the layers. Using the process, air-lifted inductors can be fabricated with solid Cu and CRS conductors. The measured result of a solid Cu inductor was found to be inferior to that of the simulated one in terms of Q-factor. This may be attributed to the roughness of the conductor surface and defects during thin film deposition as shown in the image of FIG. 29. The RF/microwave resistance can be affected by the surface roughness as in:

$$R' = R_0\left[1 + \frac{2}{\pi}\tan^{-1}\left(1.4\cdot\left(\frac{\Delta}{\delta}\right)^2\right)\right]. \tag{8}$$

where $R_0$ is the resistance due to the perfectly smooth conductors, R' is the resistance corrected for surface roughness, Δ is the rms surface roughness, and δ is the skin depth of the conductors.

Figure 30:
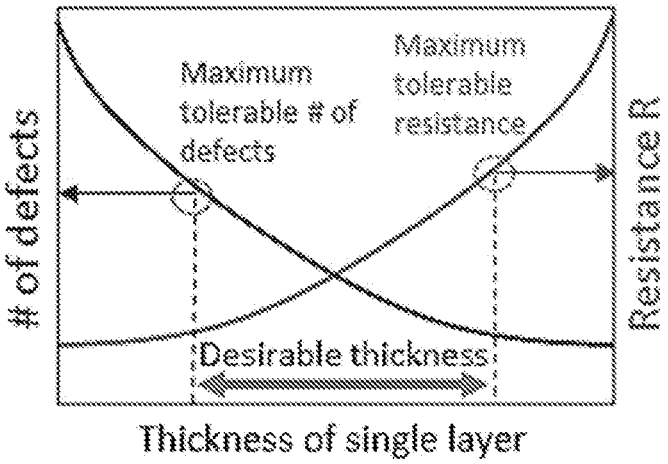
FIG. 30 illustrates an example of design criteria for the thickness of a single layer of a CRS structure in accordance with various embodiments of the present disclosure.

The surface roughness can be measured and the device modeled taking into account the roughness. For example, electroplating conditions for smooth surface can be incorporated for ideal nanoscale superlattice structures. As the thickness of a single layer of the superlattice is decreased, low loss performance can be improved while the number of defects will likely be increased. Therefore, the minimum thickness of a single layer should be determined by considering both device performance (low loss) and fabrication constraint (low numbers of defects) as illustrated in FIG. 30. As can be seen, the upper limit of the thickness can be bounded by the maximum tolerable resistance and the lower limit can be bounded by the maximum tolerable number of defects. A desirable thickness range can be obtained between those thicknesses shown in FIG. 30.

Figure 31A:
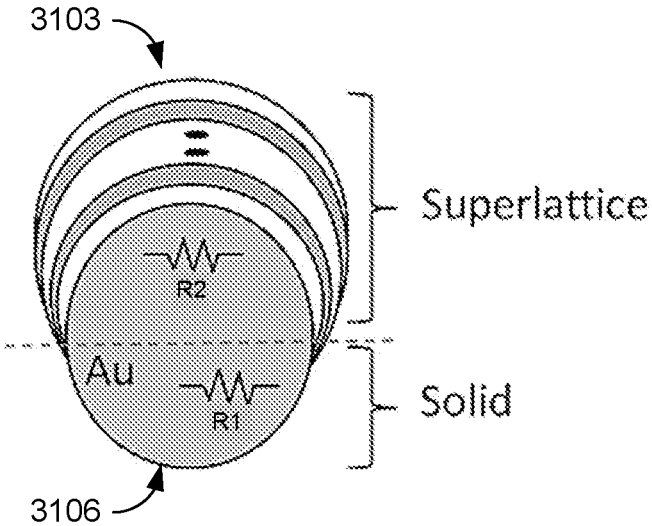
FIGS. 31A and 31B illustrate an example of the cross section of a solid/CRS hybrid conductor and the Q-factor bandwidth of the hybrid conductor based inductor in accordance with various embodiments of the present disclosure.

The measured Q-factor of the CRS based inductor also shows higher values in lower frequencies than the calculated one of the CRS based inductor. In fact, the measured Q-factor values are positioned between the Q-factor of the solid based inductor and the CRS based inductor. Properly controlled, this kind of Q-factor performance can be utilized for broadband high Q-factor (low-loss) conductor performance. Such conductor architecture can be implemented using different metallization schemes. Instead of using electroplating, vacuum deposition such as, e.g., sputtering and evaporation or atomic layer deposition can be used for superlattice metallization. Since those processes make directional deposition (evaporation offers more directional deposition than sputtering), the cylindrical wire will form a hybrid superlattice architecture. As illustrated in FIG. 31A, a first half 3103 is metallized with, e.g., sputtering or evaporation to form a superlattice architecture while the other half 3106 that is shaded by its body forms a solid architecture.

The total resistance of the hybrid conductor can be modeled as two resistors R1 and R2 connected in parallel, where R1 is the half 3106 of the original solid conductor ($=R_s/2$) and R2 is the half 3103 of the CRS conductor ($=R_{crs}/2$). The total resistance $R_t$ can be calculated as $(2R_s*R_{crs})/(R_s+R_{crs})$, which can be translated into Q-factor ($\propto 1/R_t$) as given by:

$$Q = \frac{1}{2}\omega L\left[\frac{R_s + R_{crs}}{R_s R_{crs}}\right]. \tag{9}$$

Figure 31B:
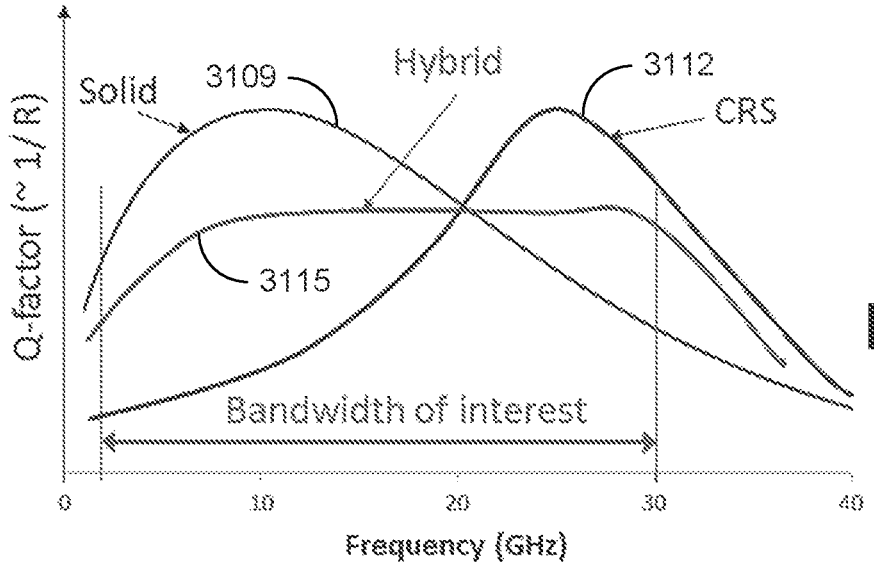

This is schematically illustrated in FIG. 31B. Curves 3109, 3112 and 3115 represent the Q-factors of the solid based inductor, the CRS inductor, and the solid/CRS hybrid inductor, respectively. Although the peak available Q-factor may not be achieved with the hybrid, an average Q-factor with a nominal Q greater than 20 can be achieved throughout the range of frequencies between 1 GHz and 30 GHz. A hybrid structure is demonstrated in FIG. 29 which partially forms the CRS structure although the surface is rough, while the defect area serves as the solid conductor. As a result, the Q-factor shows a broadband property as described above.

While the hybrid conductor of FIG. 31A is illustrated with a circular core, other core shapes can also be used such as, e.g., rectangular (squares, rectangles, planar, etc.), triangular, or other geometric cross-section (pentagons, hexagons, etc.). The superlattice architecture can be disposed on a portion (e.g., half or a smaller or larger fraction) of the outer surface of the core, while another portion of the outer surface remains uncoated. In some implementations, the superlattice architecture can be disposed on a side of the core (e.g., the top or bottom of a planar core). The core can comprise non-ferromagnetic (e.g., Cu, Au, Al, Ag, carbon nanotube, carbon nanofibers, graphene, etc.), ferromagnetic (e.g., Ni, NiFe, etc.) and/or insulating (e.g., polymers, ceramics, air, etc.) materials.

Figure 32:
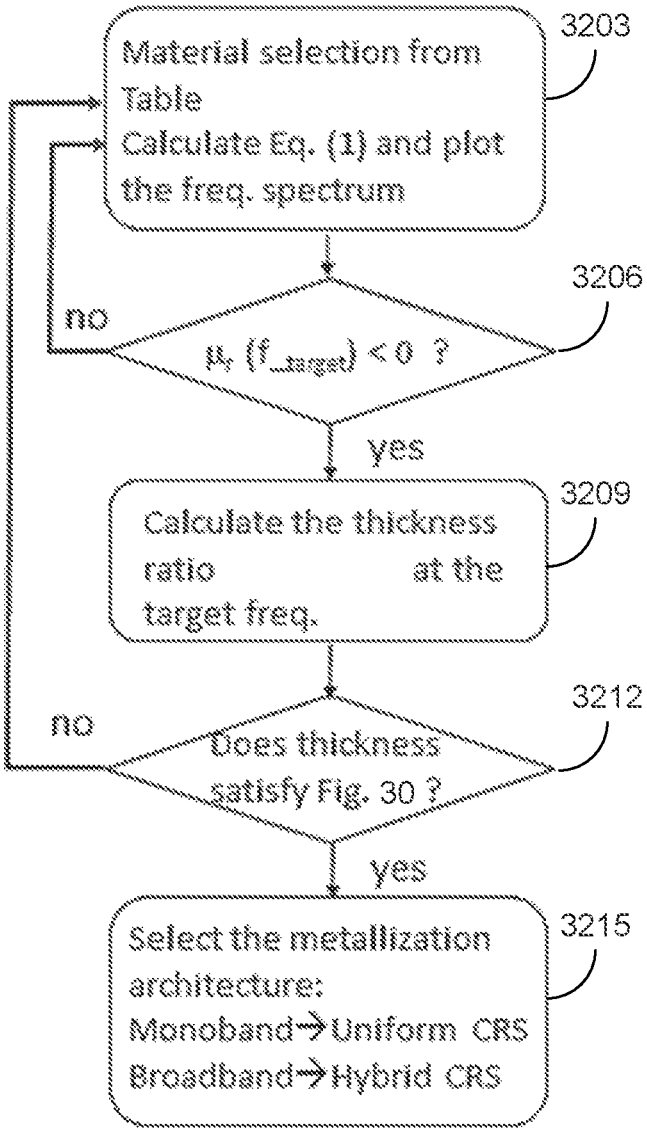
FIG. 32 is a flowchart illustrating an example of CRS structure design in accordance with various embodiments of the present disclosure.

Referring next to FIG. 32, shown is an example of a procedure for the design and implementation of CRS conductors. Beginning at 3203, frequency spectra of various ferromagnetic materials can be calculated using the LLG equation (1) and/or $f_{MR}$ and $f_{AR}$ can be obtained from a table such in FIG. 27. If the magnetic permeability is negative at the targeted frequency at 3206, the thickness ratio between the non-ferromagnetic and ferromagnetic materials can be calculated at the target frequency at 3209. If the magnetic permeability is not negative at 3206, the material selection procedure should be repeated at 3203. At 3212, the criteria of the single layer thickness can be checked to make sure it satisfies the maximum tolerable resistance and the maximum tolerable number of defects as shown in FIG. 30. For example, the recommended thickness of the ferromagnetic material can be in a range between about 5 nm and about 50 nm.

If yes, the metallization architecture can be determined depending on the desired frequency band response at 3215. Narrow band (or Monoband) low loss conductors can be chosen by forming a uniform CRS architecture, which can be realized by electroplating or atomic layer deposition (ALD), while broadband low loss conductors can be implemented by forming a solid/CRS hybrid architecture, which can be realized by sputtering and/or evaporation. If the condition at 3212 is not satisfied, the design procedure repeats with the material selection and analysis at 3203.

In this presentation, the effects of the width and thickness of the Cu/Ni superlattice conductors have been studied for more effective eddy current cancelling. Pure Ni can be used as an appropriate ferromagnetic material to realize high performance multi-layer superlattice CPW transmission lines. The Ni in the Cu/Ni pair has a high contrast between its in-plane and out-of-plane magnetic coercivity suitable for the thin film superlattice ECC conductors, is an abundant material, and does not need a stoichiometric control of composition as other alloy type magnetic materials do. The effects of the physical dimensions of the superlattice conductors were found to have a huge impact on the overall conductor loss reduction and were studied to provide guidelines for designing multi-layer conductors with improved RF performance. High performance transmission lines and interconnects were fabricated and characterized for the proof of concept, and their performance was shown to be superior to that of other state-of-the-art devices reported.

Superlattice structures consisting of ferromagnetic/non-ferromagnetic metals (e.g., Ni/Cu) can be used to create high performance conductors for radio frequency (RF) transmission lines, low loss vias in CMOS and through silicon/glass via (TSV/TGV) structures, and other structures (e.g., inductors, antennas, resonators, etc.), whose ohmic resistance and RC delays have been greatly reduced. Two permalloys of $Ni_{80}Fe_{20}$ and FeCo were studied as the ferromagnetic materials with low and high magnetization saturation that can be used for designing superlattice structures with low and high GHz frequency ranges, respectively. In addition, copper/nickel (Cu/Ni) paired superlattice conductors have been shown to provide reduced RF loss based upon eddy current cancelling (ECC). The effects of design parameters including the number of layers and thickness ratio of the superlattice structures were examined. A Radial superlattice structures including NiFe/Cu layers were implemented and their resistance compared with control solid-core devices made of copper; illustrating the effectiveness of the radial superlattice structure for reducing the RF loss. CRS conductors made of alternating magnetic/non-magnetic layers grown on a radial conductor operating in the microwave range was discussed. The CRS structure forces the high frequency current to flow through the volume of the conductor by suppressing the generated eddy currents inside the conductor which will lead to reduction of the conductor loss. A microwave inductor made of the CRS conductor was demonstrated and shown to have a Q-factor of 45 at 18 GHz, which may be attributed to low conductor and dielectric losses.

The theoretical and simulation results show a significant reduction in the conductor loss of vias in microelectronic structures including TSVs/TGVs. Magnetic materials with smaller magnetic saturation ($M_s$) such as NiFe have lower $f_{MR}$ and are suitable for lower frequency ranges, which can be utilized in applications such as digital microprocessors.

NiFe and FeCo can be used as the ferromagnetic materials for low and high frequency operation, respectively, while electroplated Cu can be used as a non-ferromagnetic conductor material. The effect of the number of layers for the superlattice structure and the characteristics of the vias using different materials for a number of frequency ranges were examined. The fabrication of the superlattice structure is fully compatible with the standard MEMS and CMOS processes. Therefore, the integration of the CRS structure with current microfabrication processes is extended to a long-term solution for maximally reducing the loss in high-speed and radio frequency (RF) devices ranging from analog, digital and mixed signal applications in digital microprocessors, analog-to-digital converters to RF inductors, antennas and metamaterials.

The experimental implementation of CRS conductors and one of their potential applications as a high Q-factor inductor was demonstrated. The proposed inductors benefit from the cylindrical radial shape of the conductors which has a closed boundary condition in a azimuthal direction with no fringing effects and therefore is considered more appropriate for eddy current suppression. The simulation and measurement results on the reduction of the conductor loss were verified. The highest Q-factor Ku band inductor showed a Q-factor of 45 at 18 GHz, where the high Q-factor may be attributed to the low dielectric loss from the air-lifted architecture and the low conductor loss from the CRS conductor. Besides high Q-factor inductors, the CRS structure may be extended to low loss passive devices including coaxial transmission lines and antennas. The fabrication method is fully compatible with the standard MEMS and CMOS processes and therefore can be integrated with the current manufacturing processes for reducing the RF loss. In this work, NiFe with $f_{AR}$=28 GHz was used which limits the maximum frequency of operation to be smaller than $f_{AR}$; however, other ferromagnetic materials with a higher $f_{AR}$ can be used to design low loss passive devices in higher frequency ranges.

The effects of Cu/Ni superlattice conductors have also been studied and shown to be even more effective for eddy current cancelling. Pure Ni can be used as an appropriate ferromagnetic material to realize high performance multilayer superlattice CPW transmission lines.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y'".

Therefore, at least the following is claimed:

1. A planar conductor, comprising:

a plurality of stacked layers including:

a plurality of first thin film layers of a first metal, the first metal selected from the group consisting of copper, aluminum, silver and gold; and a plurality of second thin film layers of a second metal, the second metal selected from the group consisting of iron, nickel and cobalt, where adjacent first thin film layers of the plurality of first thin film layers are separated by a second thin film layer of the plurality of second thin film layers.

2. The planar conductor of claim 1, wherein individual second layers of the plurality of second thin film layers have a thickness of less than 25 nanometers (nm).

3. The planar conductor of claim 2, wherein the thickness of the plurality of second thin film layers is in a range from about 10 nm to about 15 nm.

4. The planar conductor of claim 1, wherein a thickness of individual first layers of the plurality of first thin film layers is a predefined multiple of a thickness of individual second layers of the plurality of second thin film layers.

5. The planar conductor of claim 1, wherein the planar conductor is included in one of a transmission line, an interconnect, an inductor, a transformer, an antenna, or a resonator.

6. A conductor, comprising:

a plurality of radially distributed layers including:

a non-ferromagnetic core;

a first layer of a first metal disposed about and encircling the non-ferromagnetic core, the first metal selected from the group consisting of iron, nickel and cobalt; and a second layer of a second metal disposed on and encircling the first layer, the second metal selected from the group consisting of copper, aluminum, silver and gold.

7. The conductor of claim 6, wherein the plurality of radially distributed layers comprises a plurality of first layers alternating with a plurality of second layers.

8. The conductor of claim 7, further comprising an insulation layer disposed on and encircling an outermost second layer of the plurality of second layers.

9. The conductor of claim 6, wherein the non-ferromagnetic core comprises copper.

10. The conductor of claim 6, wherein the non-ferromagnetic core comprises a void containing air.

11. The conductor of claim 6, wherein the conductor is a coaxial cable.

12. The conductor of claim 6, wherein the conductor is included in one of a transmission line, an interconnect, an inductor, a transformer, an antenna, or a resonator.

13. The conductor of claim 12, wherein the interconnect is a through silicon via (TSV), a through glass via (TGV), or a through organic via (TOV).

14. A hybrid conductor, comprising:

a core; and a plurality of radially distributed layers disposed about a portion of an outer surface of the core, where the plurality of radially distributed layers comprise alternating ferromagnetic and non-ferromagnetic layers, the ferromagnetic layers selected from the group consisting of iron, nickel and cobalt, and the non-ferromagnetic layers selected from the group consisting of copper, aluminum, silver and gold.

15. The hybrid conductor of claim 14, wherein the core comprises a circular cross-section, and the plurality of radially distributed layers are disposed on a fractional portion of the outer surface of the core and not on a remaining portion of the outer surface of the core.

16. The hybrid conductor of claim 15, wherein the plurality of radially distributed layers disposed on about half of the outer surface of the core.

17. The hybrid conductor of claim 14, wherein the core comprises a rectangular cross-section.

18. The hybrid conductor of claim 17, wherein the core is a planar conductor, and the plurality of radially distributed layers encircle the planar conductor.

19. The hybrid conductor of claim 17, wherein the plurality of radially distributed layers are disposed on more than one side of the core.

20. The hybrid conductor of claim 14, wherein the core consists of copper.

* * * * *